US006227302B1

(12) United States Patent
Pringle et al.

(10) Patent No.: US 6,227,302 B1
(45) Date of Patent: May 8, 2001

(54) APPARATUS AND METHOD FOR CONTROLLING FLUID FLOW IN A WELLBORE

(75) Inventors: Ronald E. Pringle, Houston; Clay W. Milligan, Jr., Missouri City, both of TX (US)

(73) Assignee: Cameo International, Inc., Houston, TX (US)

( * ) Notice: Subject to any disclaimer, the term of this patent is extended or adjusted under 35 U.S.C. 154(b) by 0 days.

(21) Appl. No.: 09/325,474

(22) Filed: Jun. 3, 1999

(51) Int. Cl.[7] ..... E21B 34/10

(52) U.S. Cl. ..... 166/374; 166/386; 166/387; 166/320; 166/323; 166/238; 166/242.5

(58) Field of Search ..... 166/305.1, 316, 166/320, 323, 238, 242.5, 373, 374, 386, 387

(56) References Cited

U.S. PATENT DOCUMENTS

| | | |
|---|---|---|
| 3,280,914 | 10/1966 | Sizer et al. . |
| 4,858,644 | 8/1989 | Decker . |
| 5,172,717 | 12/1992 | Boyle et al. . |
| 5,176,164 | 1/1993 | Boyle . |
| 5,469,878 | 11/1995 | Pringle . |
| 5,535,767 | 7/1996 | Schnatzmeyer et al. . |
| 5,823,263 | 10/1998 | Morris et al. . |
| 5,875,852 | 3/1999 | Floyd et al. . |
| 5,896,924 | 4/1999 | Carmody et al. . |
| 5,971,004 | 10/1999 | Pringle . |
| 6,068,015 | 5/2000 | Pringle . |
| 6,070,608 | 6/2000 | Pringle . |

OTHER PUBLICATIONS

U.S. application No. 60/108,810, Pringle et al., filed Nov. 17, 1998

U.S. application No. 09/243,401, Malone, filed Feb. 1, 1999.

*Primary Examiner*—Roger Schoeppel

(74) *Attorney, Agent, or Firm*—Trop, Pruner & Hu P.C.

(57) ABSTRACT

An apparatus and method for controlling the fluid flow in a wellbore provides a side pocket mandrel having a main bore, an offset bore, and a radial passageway providing communication therebetween. Inlet orifices through the outer wall of the mandrel provide fluid communication between the offset bore and an exterior of the mandrel. A choke, or valve, attached to the mandrel is adjustable at and between an opened and closed position to control the flow rate through the inlet orifices and into the offset bore. The radial passageway and the inlet orifices are sized to provide full bore flow into the main bore and, thus, the tubing. Well tools may be positioned in the offset bore to perform various functions. Examples of such well tools include a seal bore protector adapted to protect the walls of the offset bore; an injection valve adapted to allow flow out of the mandrel only to facilitate injection into the formation; and a pack off valve adapted to seal the offset bore and prevent fluid flow therethrough.

70 Claims, 16 Drawing Sheets

APPARATUS AND METHOD FOR CONTROLLING FLUID FLOW IN A WELLBORE

BACKGROUND OF THE INVENTION

1. Field of Invention

The present invention relates to the field of flow control. More specifically, the invention relates to a device and method for controlling the flow of fluids in a wellbore that, in one embodiment, provides for full tubing flow.

2. Related Art

The economic climate of the petroleum industry demands that oil companies continually improve their recovery systems to produce oil and gas more efficiently and economically from sources that are continually more difficult to exploit and without increasing the cost to the consumer. One successful technique currently employed is the drilling of horizontal, deviated, and multilateral wells, in which a number of deviated wells are drilled from a main borehole. In such wells, and in standard vertical wells, the well may pass through various hydrocarbon bearing zones or may extend through a single zone for a long distance. One manner to increase the production of the well, therefore, is to perforate the well in a number of different locations, either in the same hydrocarbon bearing zone or in different hydrocarbon bearing zones, and thereby increase the flow of hydrocarbons into the well.

One problem associated with producing from a well in this manner relates to the control of the flow of fluids from the well and to the management of the reservoir. For example, in a well producing from a number of separate zones, or laterals in a multilateral well, in which one zone has a higher pressure than another zone, the higher pressure zone may produce into the lower pressure zone rather than to the surface. Similarly, in a horizontal well that extends through a single zone, perforations near the "heel" of the well—nearer the surface—may begin to produce water before those perforations near the "toe" of the well. The production of water near the heel reduces the overall production from the well. Likewise, gas coning may reduce the overall production from the well.

A manner of alleviating this problem is to insert a production tubing into the well, isolate each of the perforations or laterals with packers, and control the flow of fluids into or through the tubing. However, typical flow control systems provide for either on or off flow control with no provision for throttling of the flow. To fully control the reservoir and flow as needed to alleviate the above described problem, the flow must be throttled. A number of devices have been developed or suggested to provide this throttling although each has certain drawbacks. Note that throttling may also be desired in wells having a single perforated production zone.

Specifically, the prior devices are typically either wireline retrievable valves, such as those that are set within the side pocket of a mandrel, or tubing retrievable valves that are affixed to the tubing string. An example of a wireline retrievable valve is shown in U.S. patent application Ser. No. 08/912,150 (U.S. Pat. No. 6,070,608 ) by Ronald E. Pringle entitled Variable Orifice Gas Lift Valve for High Flow Rates with Detachable Power Source and Method of Using Same that was filed Aug. 15, 1997 and which is hereby incorporated herein by reference. The variable orifice valve shown in that application is selectively positionable in the offset bore of a side pocket mandrel and provides for variable flow control of fluids into the tubing. The wireline retrievable valve has the advantage of retrieval and repair while providing effective flow control into the tubing without restricting the production bore. However, one drawback associated with the current wireline retrievable-type valves is that the valves cannot attain "full bore flow." An important consideration in developing a flow control system pertains to the size of the restriction created into the tubing. It is desirable to have full bore flow meaning that the flow area through the valve when fully open should be at least about as large as the flow area of the tubing so that the full capacity of the tubing may be used for production. Therefore, a system that provides full bore flow through the valve is desired.

A typical tubing retrievable valve is the standard "sliding sleeve" valve, although other types of valves such as ball valves, flapper valves, and the like may also be used. In a sliding sleeve valve, a sleeve having orifices radially therethrough is positioned in the tubing. The sleeve is movable between an open position, in which the sleeve orifices are aligned with orifices extending through the wall of the tubing to allow flow into the tubing, and a closed position, in which the orifices are not aligned and fluid cannot flow into the tubing. Elastomeric seals extending the full circumference of the sleeve and located at the top of the sleeve and the bottom of the sleeve provide the desired sealing between the sleeve and the tubing. Due to the presence of the elastomeric seals, reliability may be an issue if the sleeve valve is left downhole for a long period of time because of exposure to caustic fluids. Further, because the valves are tubing retrievable, any failure of the valve can only be repaired by pulling the tubing from the well and replacing or repairing the valve. However, such a retrieval operation is generally impractical and always costly. Therefore, the typical manner of correcting failures in tubing retrievable valves is to "pack-off" the flow passageway with a bridge plug. Packing off the flow passageway, though, creates a restriction in the production bore and limits production. Also, the bridge plug must be removed each time the well is entered for service. Thus, although the tubing retrievable valves have the advantage of full bore flow, this advantage is often outweighed by the risk of failure.

Remote actuators for the sleeve valves have recently been developed to overcome certain other difficulties often encountered with operating the valves in horizontal wells, highly deviated wells, and subsea wells using slickline or coil tubing to actuate the valve. The remote actuators are positioned in the well proximal the valve to control the throttle position of the sleeve.

However, after a sleeve valve has been exposed to a wellbore environment for some time, the sleeve may be stuck or rendered more difficult to operate due to corrosion and debris. Additionally, the hydraulic seals of the sleeve add substantial drag to movement of the sleeve valve, rendering its operation even more difficult. Sleeve valves may require relatively large forces to overcome the drag from hydraulic seals in the valve, particularly when the sleeve valve is exposed to high pressure and corrosion. In addition, a sleeve valve may require a relatively long stroke to move between a fully open position and a fully closed position. As a result of the relatively large forces and long strokes employed to actuate a sleeve valve, an actuator employed to open and close the valve may need to be relatively high powered. Providing such high power may require a large actuator, sophisticated electronic circuitry, and relatively large diameter electrical cables, run from the surface to the valve actuator mechanism.

A solution aimed at alleviating these problems associated with the sliding sleeves is shown in application Ser. No. 09/243,401, by David L. Malone, entitled Valves for Use in Wells, filed Feb. 1, 1999 which is hereby incorporated herein by reference. In particular, that solution is to use a sophisticated valve design that has valve covers that provide a seal around the periphery of the cover and the orifice through the tubing. The valve covers are sized in accordance with the size of the orifice. In this way, the surface of contact between the cover and the tubing, or seat, is much less than that encountered with a sliding sleeve and the stroke length is decreased. Additionally, the valve uses low coefficient of friction material, such as a polycrystalline diamond coating, to facilitate sliding and incorporates a self cleaning feature aimed at removing built up debris that tends to impede valve movement.

The valves may be packaged and used in a number of ways to control the flow of fluid into the tubing (as well as through the tubing and other applications). One embodiment of the present invention is directed at a preferred manner of incorporating these valves into a workable flow control system. Note, however, that other valves may also be useable in the present system.

Despite the features of the prior art, there remains a need for a flow control system that may be repaired or packed-off without impeding the flow through the tubing, that provides for full bore flow, that reduces the power requirements for operation over previous designs, that is adaptable to the requirements of the particular well, and that provides an efficient, reliable, erosion-resistant system that can withstand the caustic environment of a well bore.

SUMMARY

Embodiments of the invention generally provide a system, apparatus, and method for controlling the rate of flow into a production tubing that utilizes a side pocket mandrel and allows for full bore flow. In general, the invention provides a side pocket mandrel that has a radial flow passageway adapted to provide fluid communication between the main bore of the mandrel and the offset bore, or side pocket, of the mandrel. Valves attached to the mandrel body selectively choke the flow through inlet orifices in the side wall of the body. The inlet orifices communicate with the side pocket. Thus, flow from the annulus formed between the tubing and the casing of the well selectively flows through the inlet orifices as allowed by the valves, into and through the side pocket, then into the main bore of the mandrel, and into the tubing. Some other major components of the system include a seal bore protector, an injection valve, and a pack-off valve each of which are adapted to be selectively and removeably run into side pocket of the mandrel. The pack-off valve seals the side pocket preventing flow therethrough.

In general, the seal bore protector is adapted to seal above and below the inlet orifices and the radial flow passageway to protect the side pocket bore walls. The seal bore protector may also have an erosion coupon between the seals and attached for positioning within the flow path between the inlet orifices and the radial flow passageway. By periodically removing the seal bore protector from the well and inspecting the erosion coupon, the well operator may have an idea of the erosion experienced by other components of the well.

The injection valve seals the side pocket and provides check valves that restrict the flow to allow flow out of the mandrel, but prevent flow into the mandrel. Thus, the injection valve facilitates injection of a production zone and prevents flow of pressurized injection fluid back into the tubing.

One aspect of the present invention provides a side pocket mandrel that comprises a body having an outer wall. The body defines a main bore that extends therethrough, and an offset bore adjacent to the main bore. The main bore is adapted to be aligned with a well tubing. The body further defines an upper passageway that extends between the main bore and an upper end of the offset bore and is adapted to provide fluid communication between them. The body also defines at least one radial flow passageway. The at least one radial flow passageway is adapted to provide fluid communication between the main bore and the offset bore. At least one inlet orifice through the outer wall of the body is adapted to provide fluid communication into and from the offset bore of the body.

Another aspect of the invention provides a system for controlling the flow of fluid into and from a downhole tubing. The system includes a mandrel that is adapted to be attached to the tubing. The mandrel defines a main bore that extends therethrough and is adapted to be aligned with the tubing, and an offset bore adjacent to the main bore. The mandrel defines at least one inlet orifice that is adapted to provide communication into and from the offset bore of the mandrel. At least one valve attached to the mandrel[JG2]. . . is adapted to control the flow rate through the at least one inlet orifice. The at least one valve is selectively positionable at and between an open position and a closed position.

Another aspect of the invention provides a seal bore protector for protecting the bore of a side pocket of a mandrel having at least one inlet orifice through an outer wall and communicating with the side pocket. The seal bore protector includes a seal bore protector body adapted to be selectively and removeably positioned in the side pocket of the mandrel. The seal bore protector body includes an upper end and a lower end. The upper seal is attached to the body proximal the upper end. The lower seal is attached to the body proximal the lower end. The upper and lower seals are adapted to seal the offset bore above and below the at least one inlet orifice respectively and substantially prevent flow past the upper and lower seals when the body is operatively positioned in the offset bore. An erosion coupon is positioned between the upper and lower seals.

Yet another aspect of the present invention is an injection valve that allows selective injection through a side pocket of a mandrel which has at least one inlet orifice through an outer wall and that communicates with the side pocket and at least one radial flow passageway to provide fluid communication between the side pocket and a main bore of the mandrel. The injection valve includes an injection valve body that is adapted to be selectively and removeably positioned in the side pocket. The injection valve body has an upper end and a lower end. The upper seal is attached to the injection valve body proximal the upper end. The lower seal is attached to the injection valve body proximal the lower end. The upper and lower seals are adapted to seal the side pocket above and below the inlet orifices and the at least one radial flow passageway respectively and substantially prevent flow past the upper and lower seals when the injection valve body is operatively positioned in the side pocket. The injection valve body and the side pocket define an annulus between the upper and lower seals. The injection valve body defines a central bore therethrough. An upper check valve is attached to the injection valve body and is positioned in the central bore proximal the upper end of the injection valve body. A lower check valve is attached to the injection valve body and is positioned in the central bore proximal the lower end of the injection valve body. The upper and lower check valves define an interior cavity as a portion of the central bore and are adapted and positioned to permit flow into the interior cavity through the central bore and to prevent flow from the interior cavity through the central bore. The injection valve body defines at least one injection passageway adapted to provide fluid communication between the annulus and the interior cavity.

An alignment pin is attached to the injection valve body. An alignment groove is defined by the mandrel. The alignment pin and alignment groove are adapted to cooperatively align the injection valve body to a predetermined orientation as the injection valve is positioned in the side pocket.

A radial plug corresponds to each of the at least one radial passageways. The radial plug has a size and shape that corresponds to the size and shape of the corresponding one of the at least one radial passageways. The radial plug is attached to the injection valve body and is selectively moveable relative to the injection valve body between a running position and a set position in which the radial plug is extended from the injection valve body. The radial plug is adapted to sealably close the corresponding one of the at least one radial passageways when the injection valve body is positioned in the side pocket and the radial plug is in the set position.

Another aspect of the invention is a pack-off valve for packing off a side pocket of a mandrel that has at least one inlet orifice through an outer wall and that communicates with the side pocket and at least one radial flow passageway providing fluid communication between the side pocket and a main bore of the mandrel. The injection valve includes a pack-off valve body adapted to be selectively and removeably positioned in the side pocket and having an upper and a lower end. An upper seal is attached to the pack-off valve body proximal the upper end and a lower seal is attached to the pack-off valve body proximal the lower end. The upper and lower seals are adapted to seal the offset bore above and below the inlet orifices respectively and substantially prevent flow past the upper and lower seals when the pack-off valve body is operatively positioned in the offset bore. An alignment pin is attached to the pack-off valve body and an alignment groove is defined by the mandrel. The alignment pin and alignment groove are adapted to cooperatively align the pack-off valve body to a predetermined orientation as the pack-off valve is positioned in the side pocket.

A radial plug corresponds to each of the at least one radial passageways. The radial plug has a size and shape corresponding to the size and shape of the corresponding one of the at least one radial passageways. The radial plug is attached to the pack-off valve body and is selectively moveable relative to the pack-off valve body between a running position and a set position in which the radial plug is extended from the pack-off valve body. The radial plug is adapted to sealably close the corresponding one of the at least one radial passageways when the pack-off valve is positioned in the side pocket and the radial plug is in the set position. The upper seal is positioned above the at least one radial passageway when the pack-off valve is operatively positioned in the side pocket. The lower seal is positioned below the at least one radial passageway when the pack-off valve is operatively positioned in the side pocket.

An aspect of the invention includes a method for controlling the flow rate of a fluid into a tubing. The method includes providing a mandrel that has at least one side pocket and at least one inlet orifice that provides fluid communication into the at least one side pocket and choking the flow rate of the fluid through the at least one orifice.

Still yet another aspect is a valve that includes a mandrel that has an outer wall and defines a main bore and an offset bore. The at least one inlet orifice is defined in and extends through the outer wall and communicates with the offset bore. The at least one cover is adapted to choke the flow through the at least one orifice.

Finally, one aspect of the invention is an apparatus for controlling the flow rate of a fluid into a tubing. The apparatus includes a mandrel that has at least one side pocket and at least one inlet orifice that provides fluid communication into the side pocket and means for choking the flow rate of the fluid through the at least one orifice.

BRIEF DESCRIPTION OF THE DRAWINGS

The manner in which these objectives and other desirable characteristics can be obtained is explained in the following description and attached drawings in which.

Figure 7:
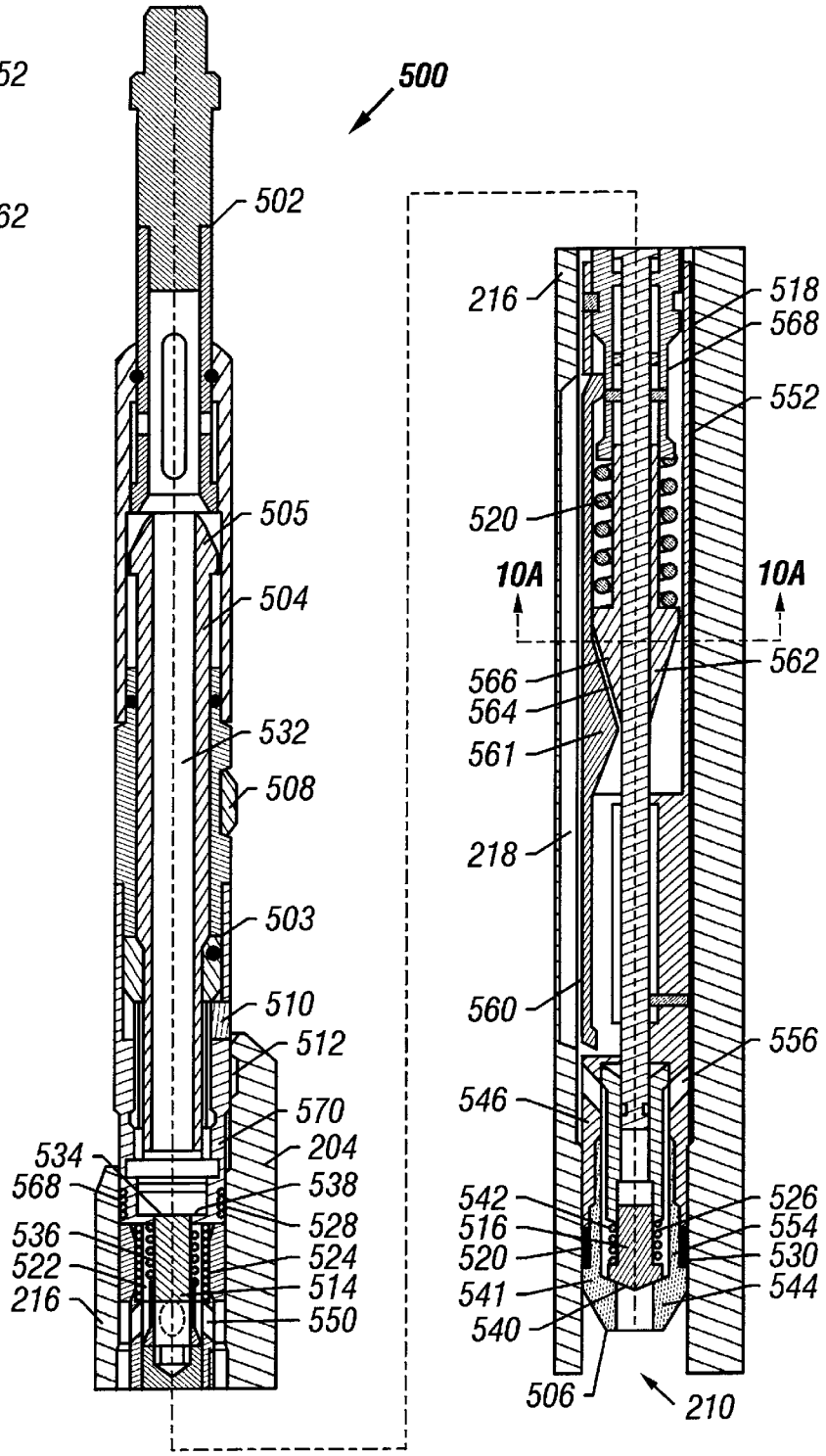
FIGS. 7–9 illustrate an injection valve tool according to one embodiment in three different positions that is adapted to be used in the side pocket mandrel of FIGS. 2A–2F.
Figure 8:
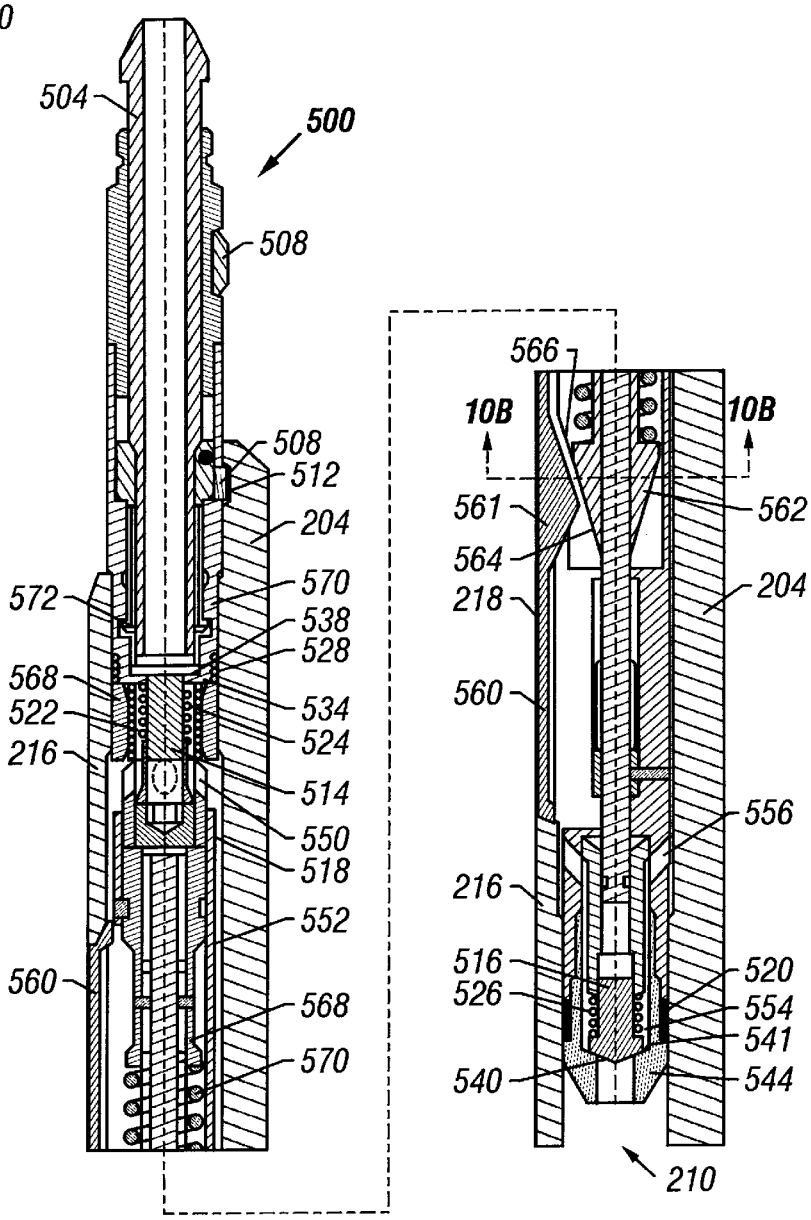
Figure 9:
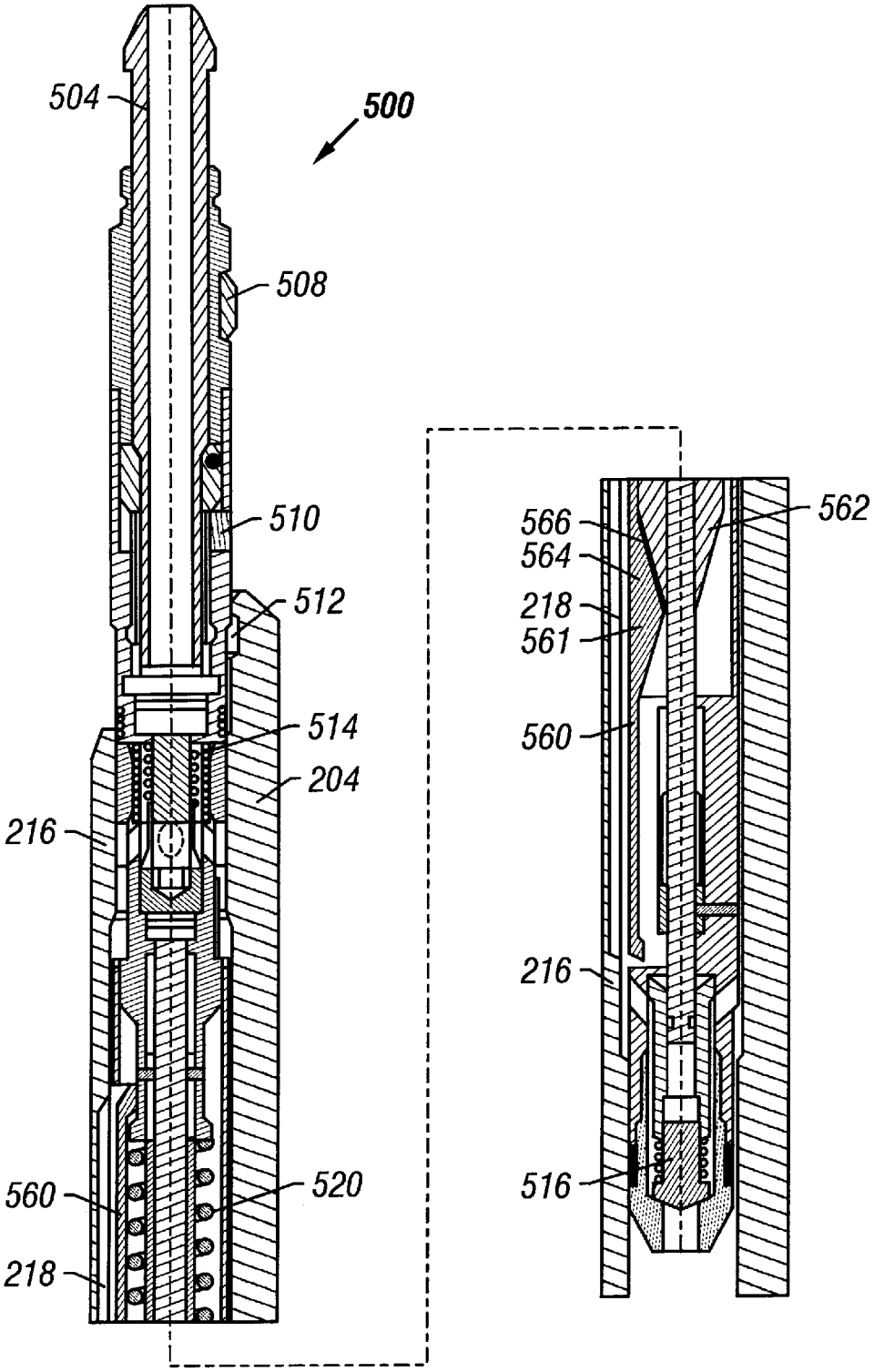

FIGS. **10A–10*b* are cross-sectional views of different portions of the injection valve tool of FIGS. 7–9**.

Figure 11:
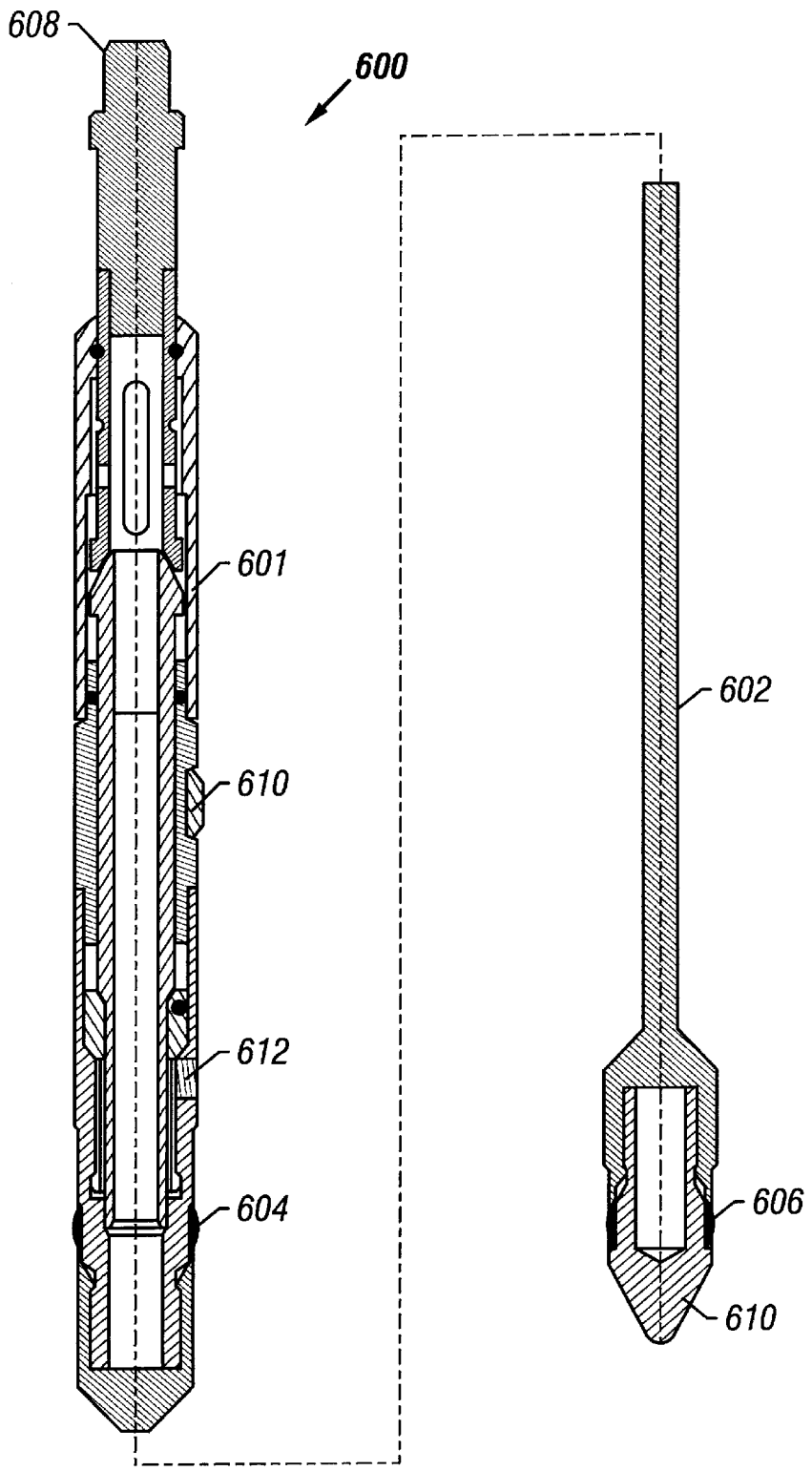

FIG. 11 illustrates a seal bore protector including an erosion coupon according to one embodiment for use in the side pocket mandrel of FIGS. 2A–2F.

Figure 12:
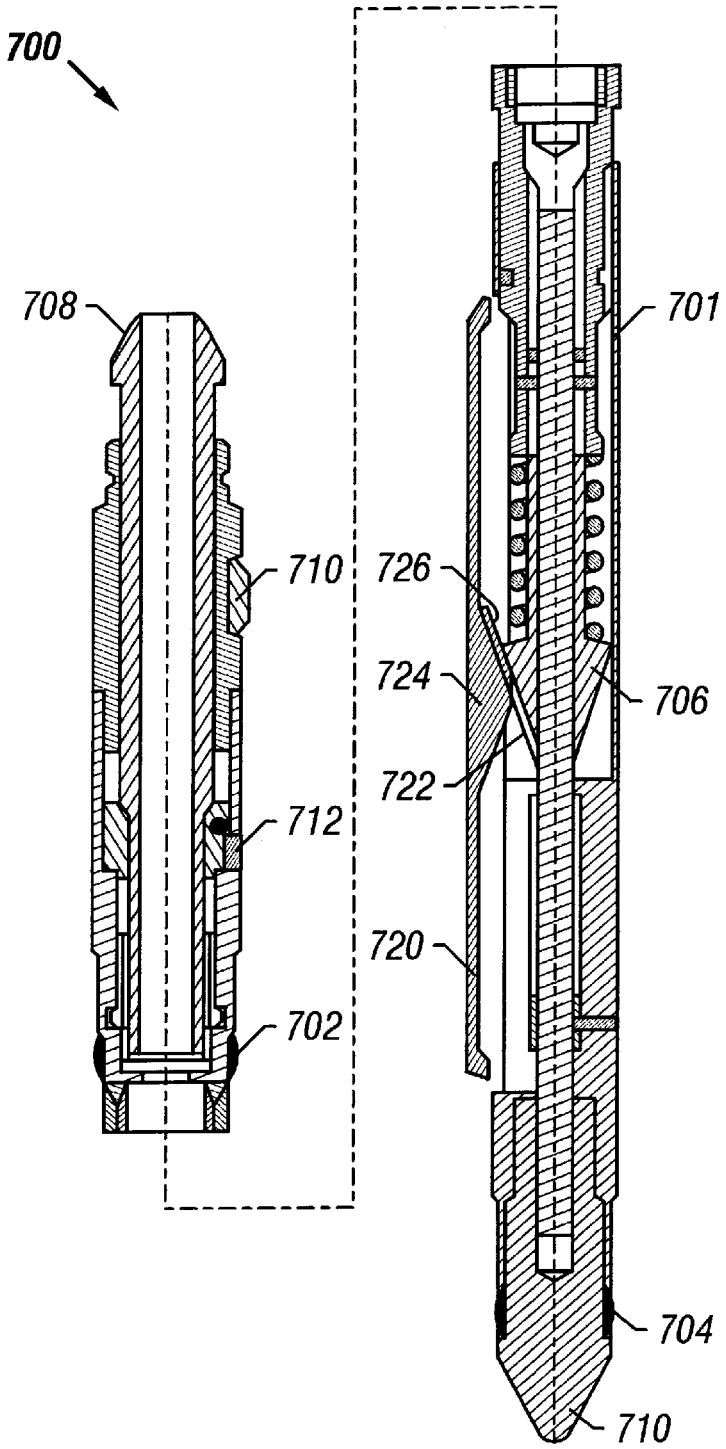

FIG. 12 illustrates a pack-off tool according to one embodiment for use in the side pocket mandrel of FIGS. 2A–2F.

Figure 13:
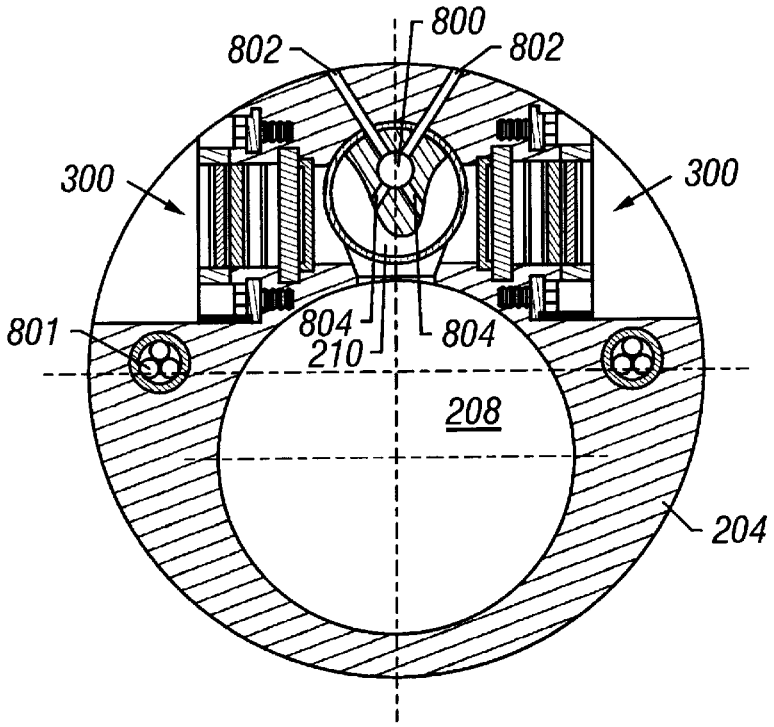

FIG. 13 is a cross sectional view showing an alternative embodiment of the present invention.

Figure 14:
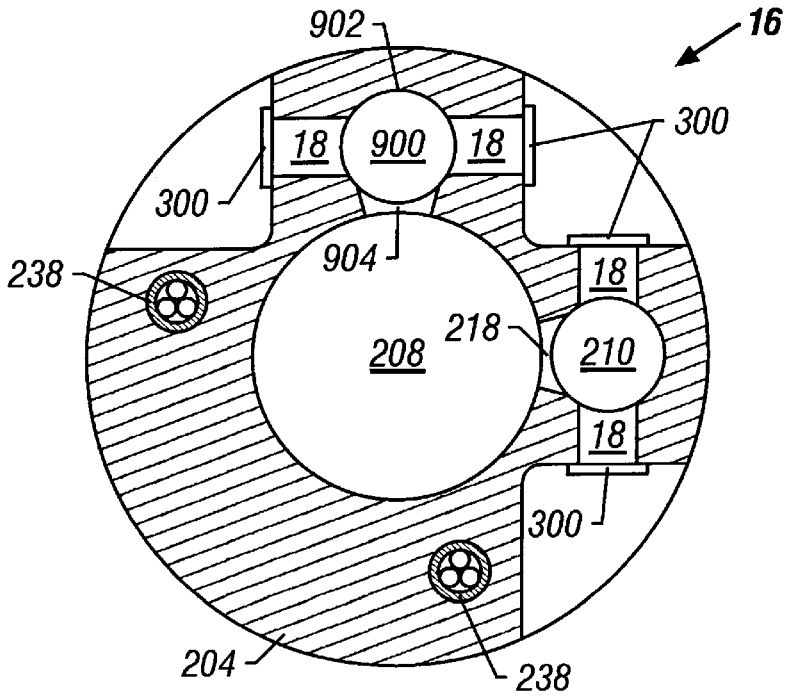
Figure 10A:
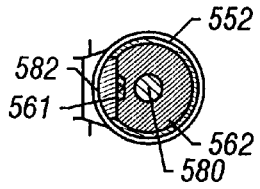
Figure 7:
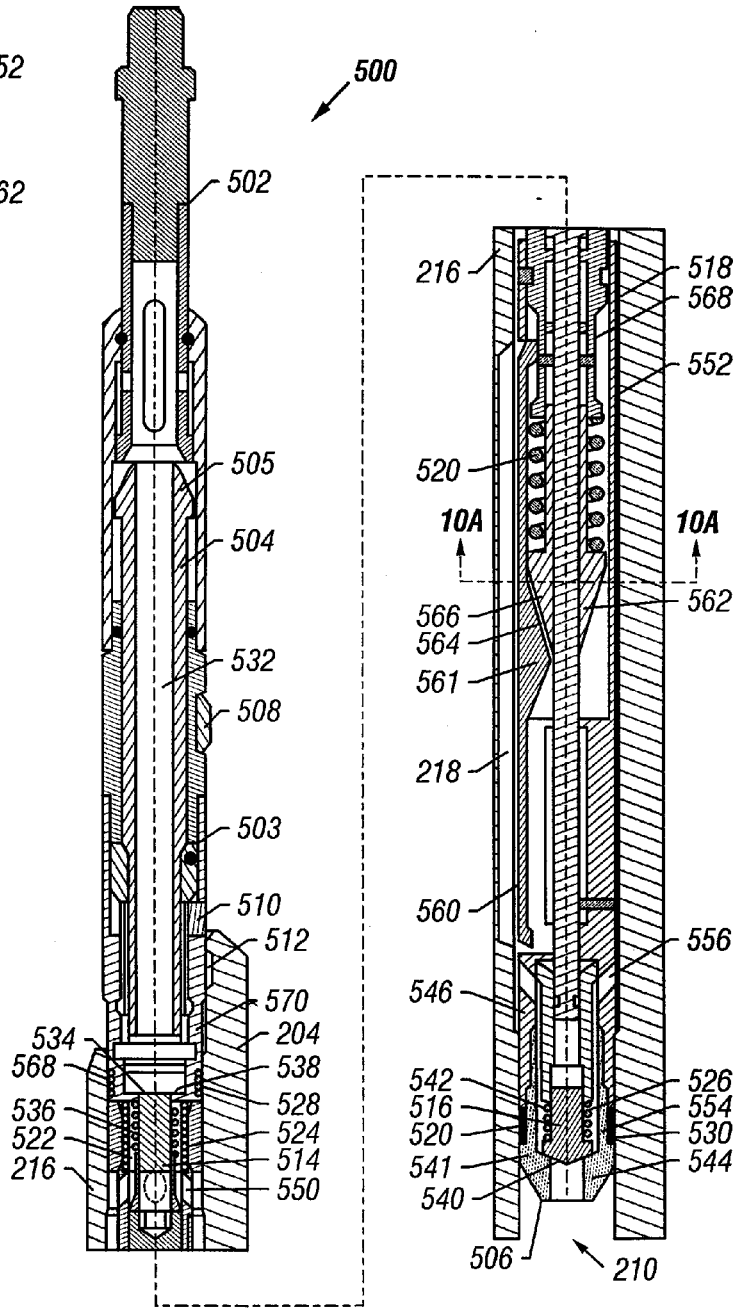
Figure 10B:
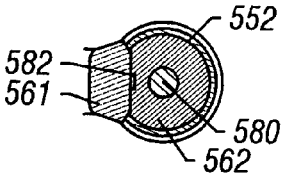
Figure 8:
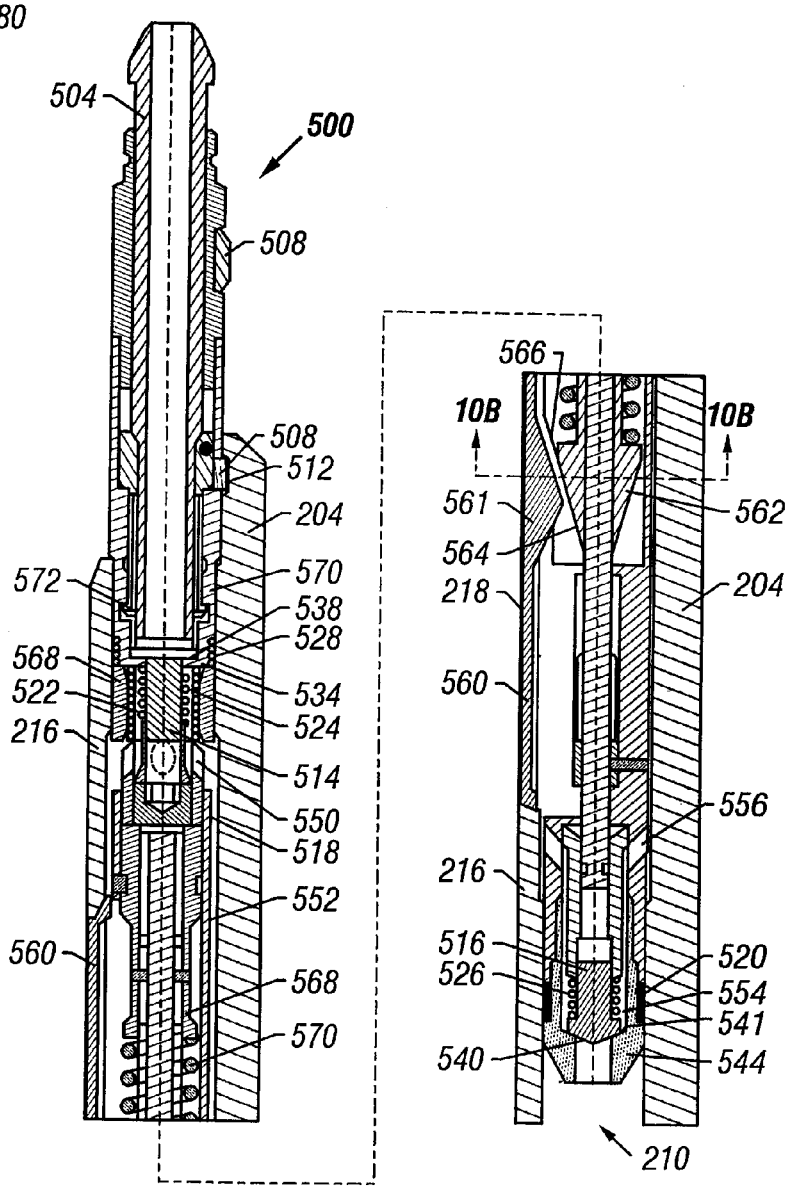
Figure 9:
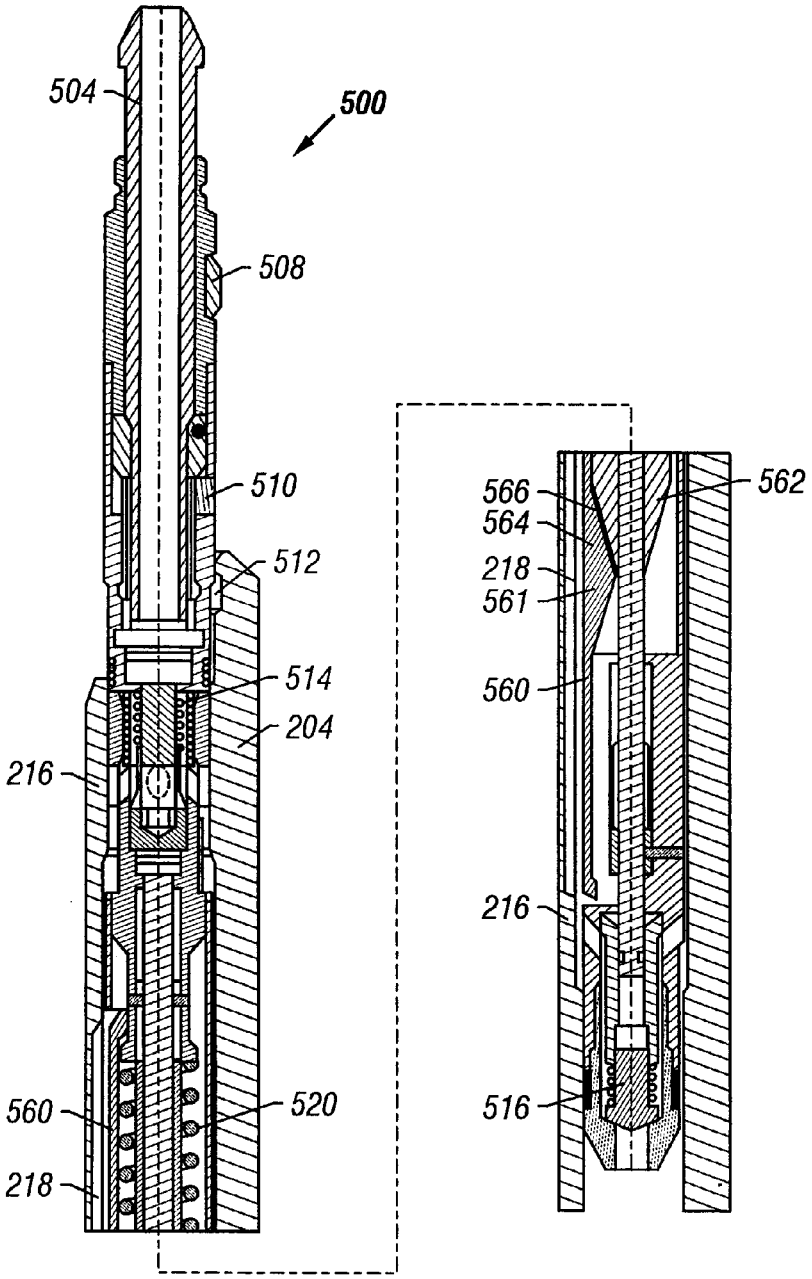

FIG. 14 is a cross sectional view showing an alternative embodiment of the present invention.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Embodiments of the invention generally provide a system, apparatus, and method for controlling the rate of flow into a production tubing that utilizes a side pocket mandrel and allows for full bore flow. In general, the invention provides a side pocket mandrel that has a radial flow passageway adapted to provide fluid communication between the main bore of the mandrel and the offset bore, or side pocket, of the mandrel. Valves attached to the mandrel body selectively choke the flow through inlet orifices in the side wall of the body. The inlet orifices communicate with the side pocket. Thus, flow from the annulus formed between the tubing and the casing of the well selectively flows through the inlet orifices as allowed by the valves, into and through the side pocket, then into the main bore of the mandrel, and into the tubing. Some other major components of the system include a seal bore protector, an injection valve, and a pack-off valve each of which are adapted to be selectively and removeably run into side pocket of the mandrel. The pack-off valve seals the side pocket preventing flow therethrough.

In general, the seal bore protector is adapted to seal above and below the inlet orifices and the radial flow passageway to protect the side pocket bore walls. The seal bore protector may also have an erosion coupon between the seals and attached for positioning within the flow path between the inlet orifices and the radial flow passageway. By periodically removing the seal bore protector from the well and inspecting the erosion coupon, the well operator may have an idea of the erosion experienced by other components of the well.

The injection valve seals the side pocket and provides check valves that restrict the flow to allow flow out of the mandrel, but prevent flow into the mandrel. Thus, the injection valve facilitates injection of a production zone and prevents flow of pressurized injection fluid back into the tubing.

A detailed description of the invention and the individual components as well as some possible alternatives and additional components follows.

Figure 1:
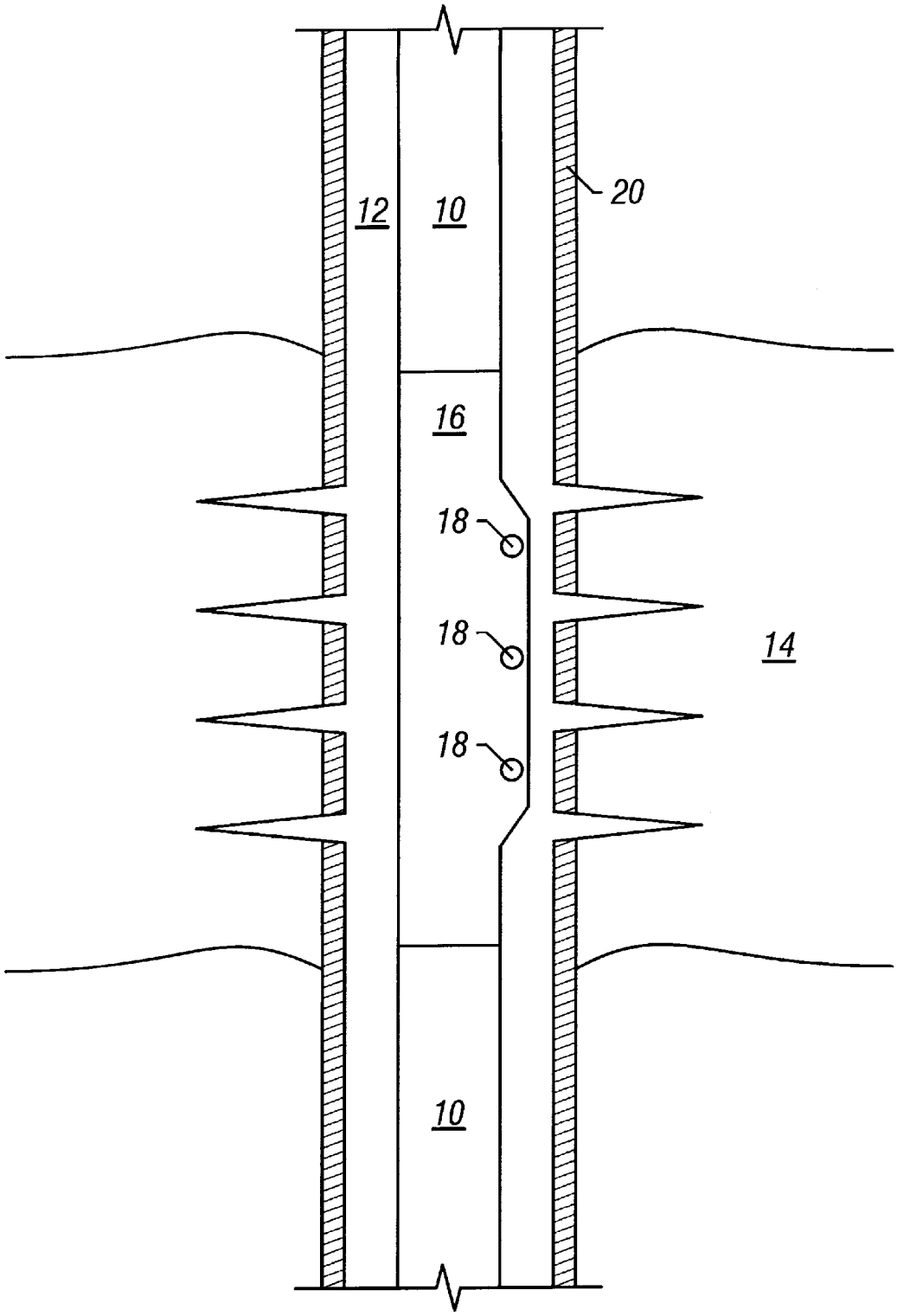
FIG. 1 is an embodiment of completion equipment including a side pocket mandrel and a wellbore.
Figure 2A:
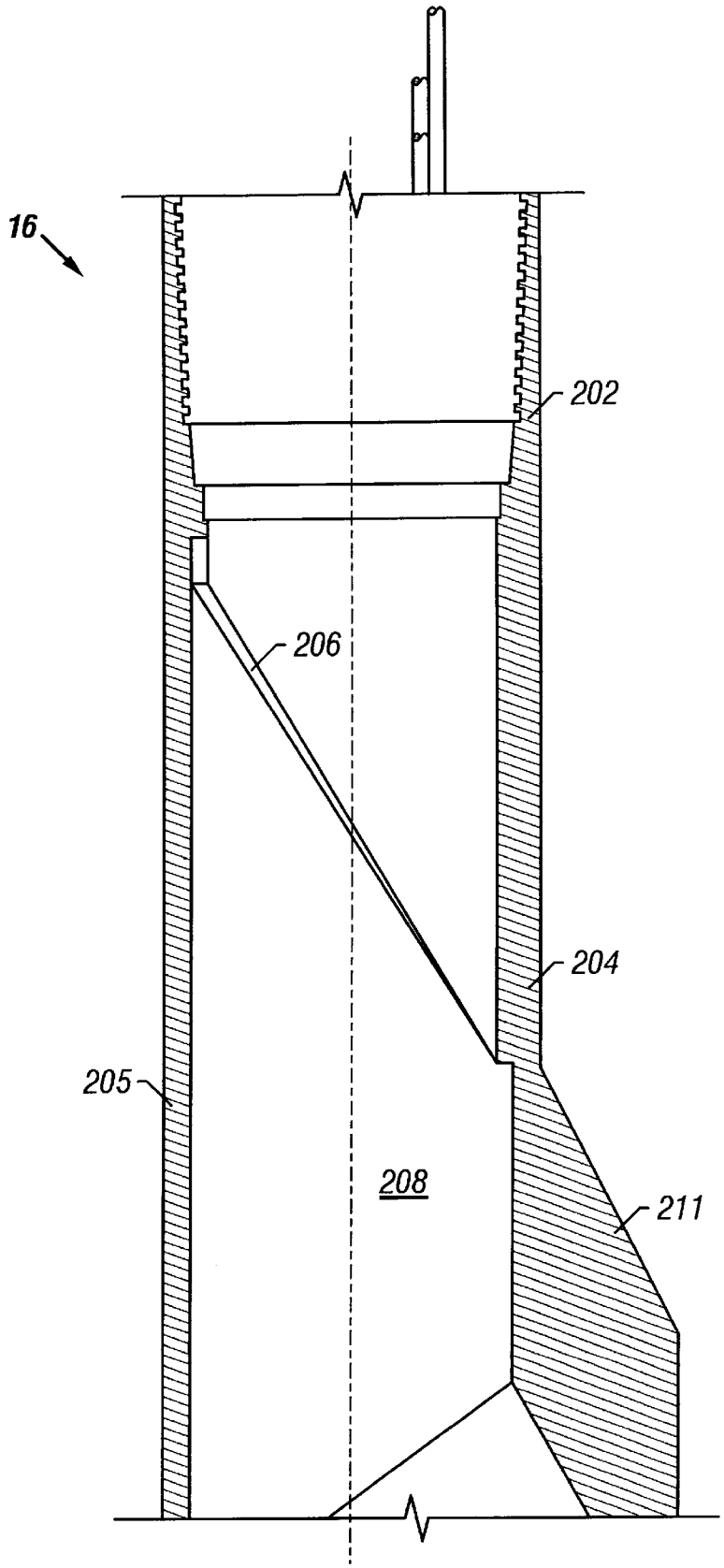
FIGS. 2A–2F illustrate the side pocket mandrel of FIG. 1.
Figure 2B:
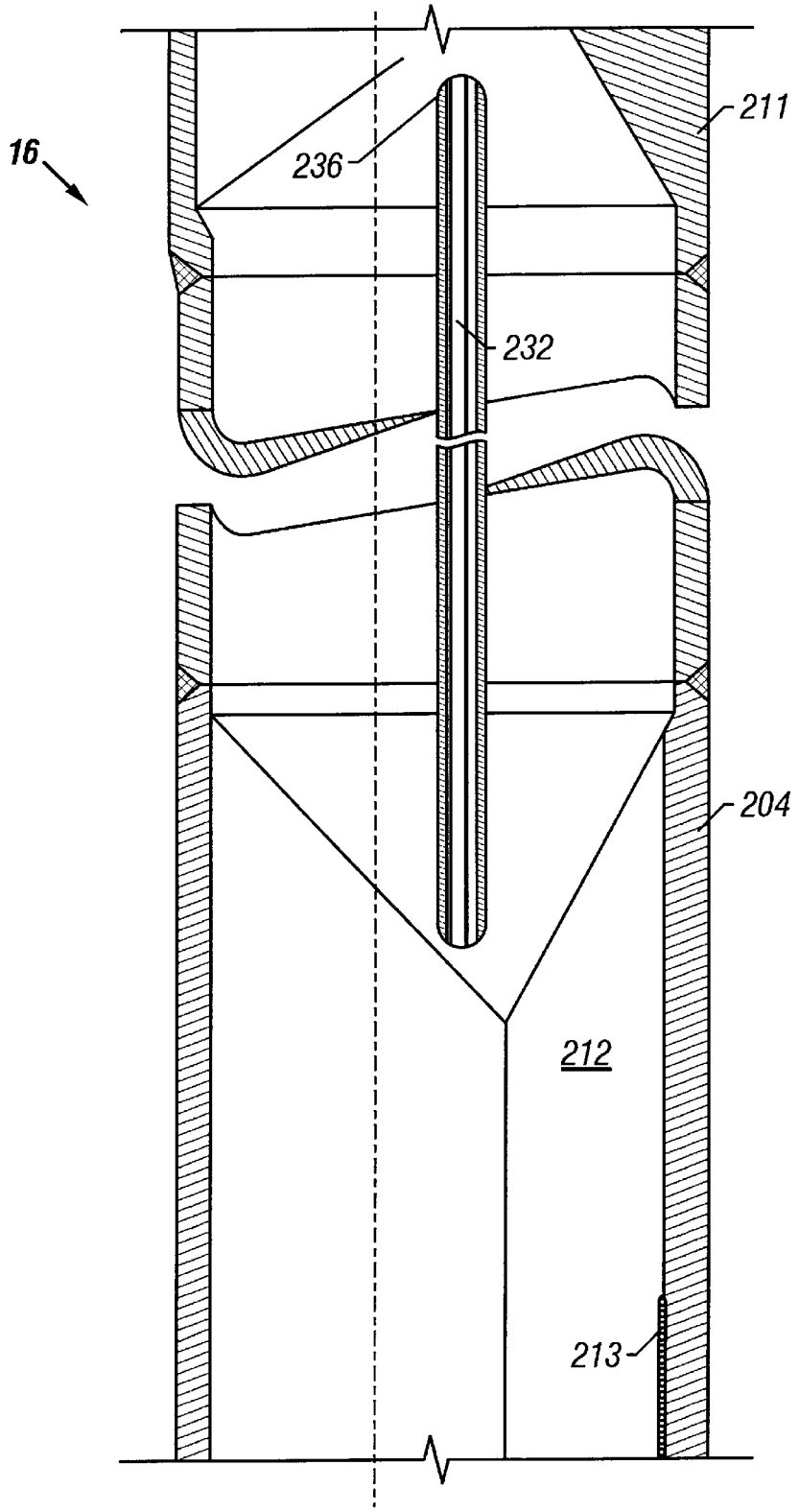
Figure 2C:
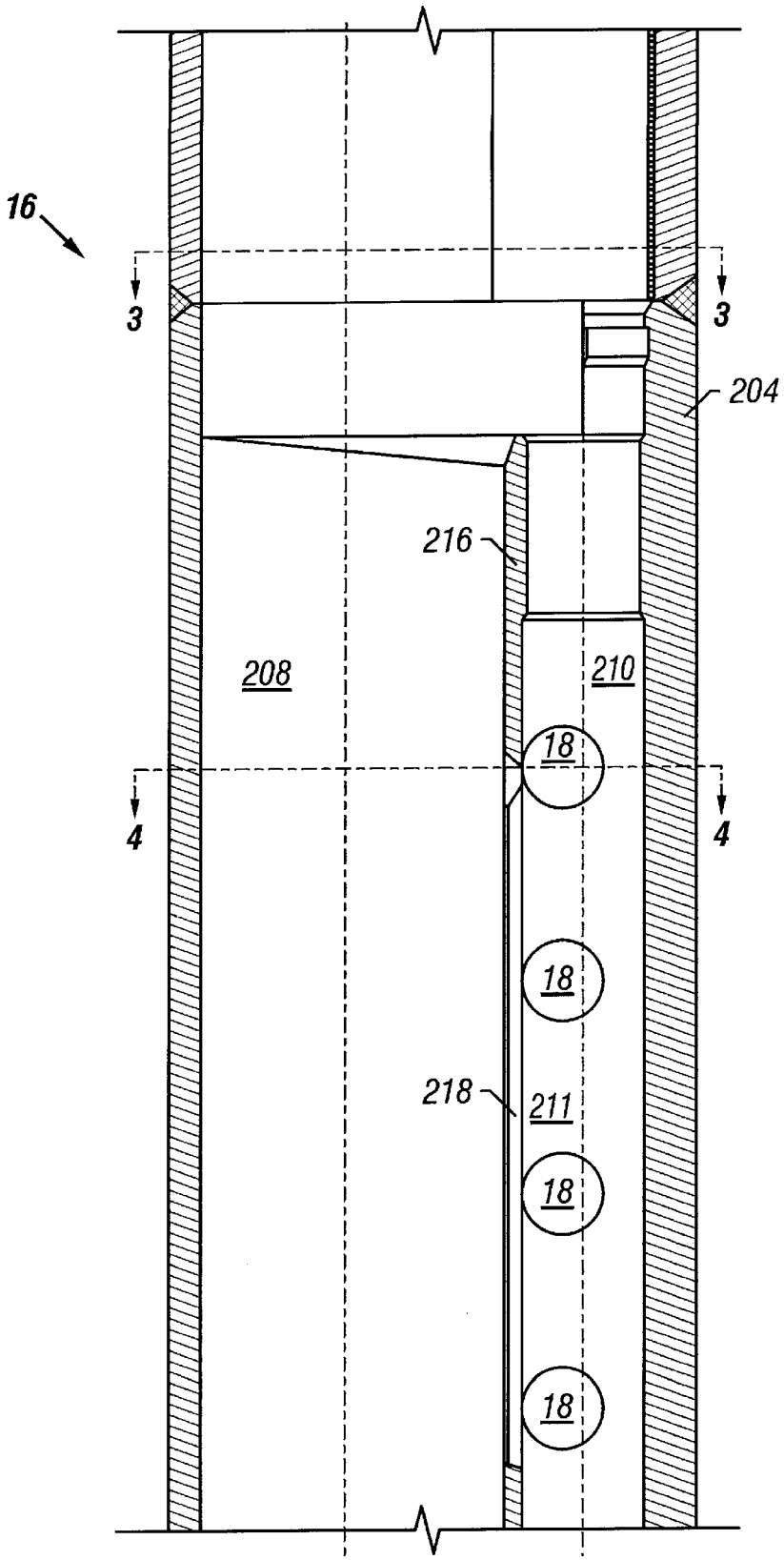
Figure 2D:
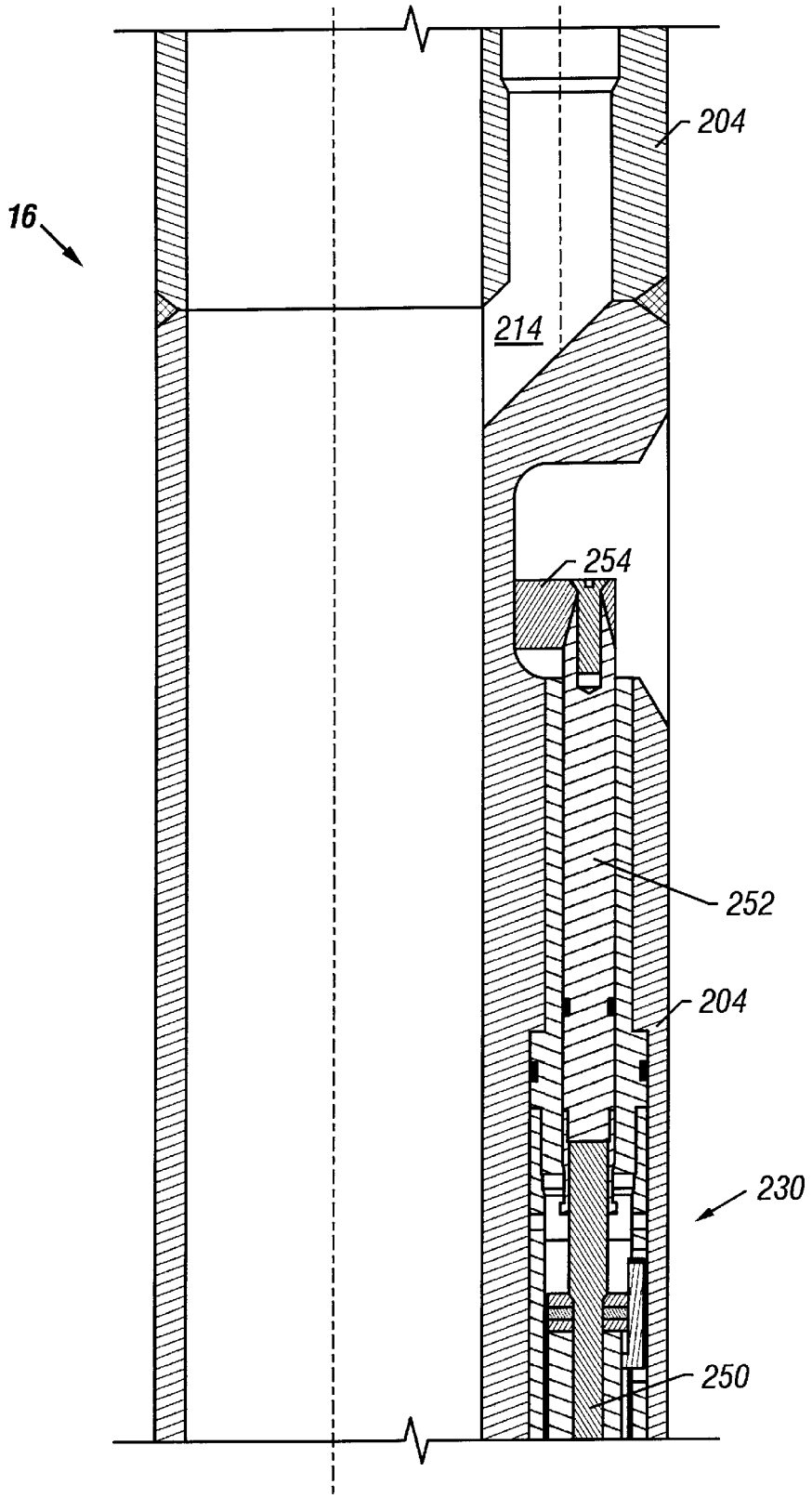
Figure 2E:
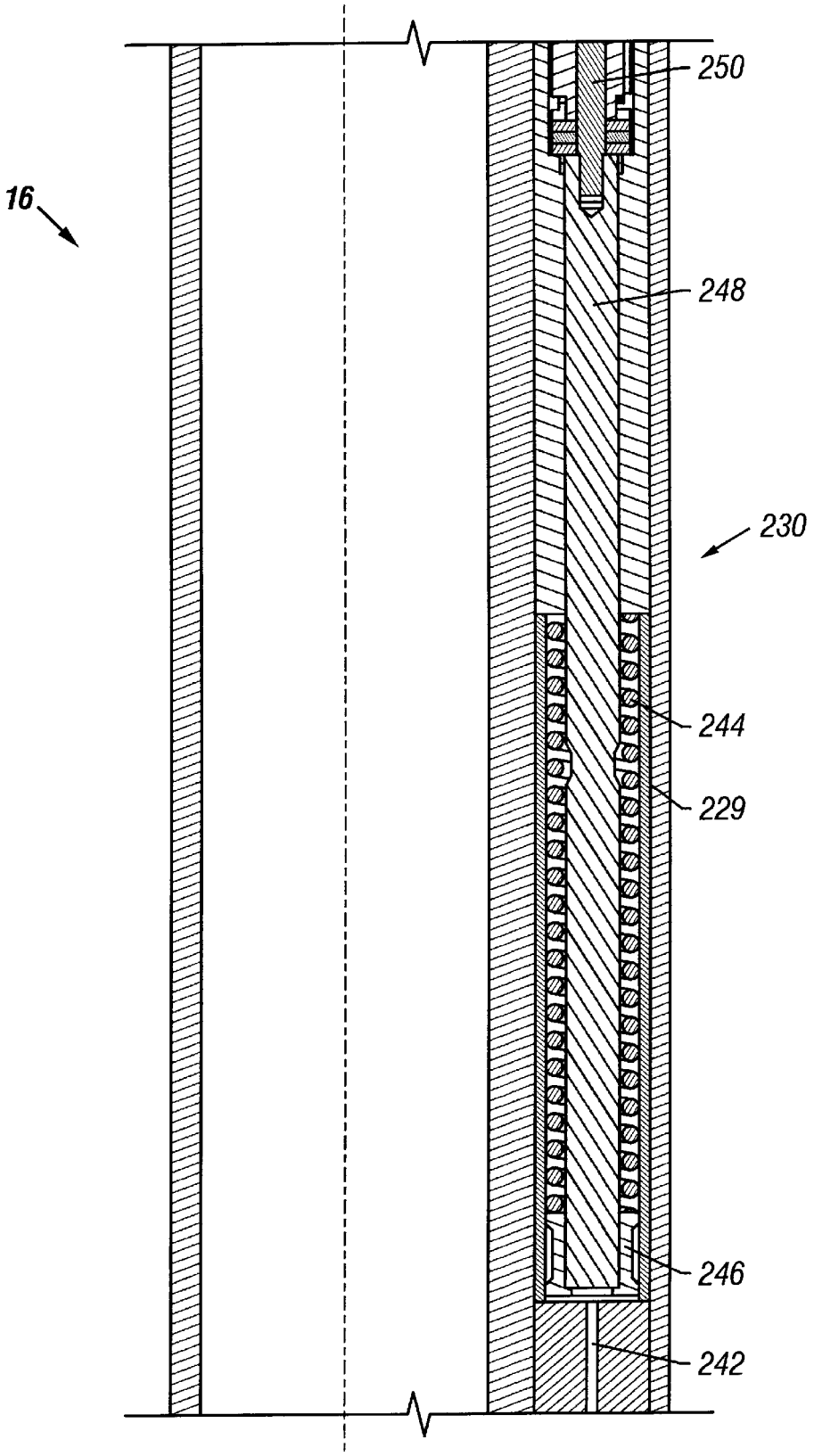
Figure 2F:
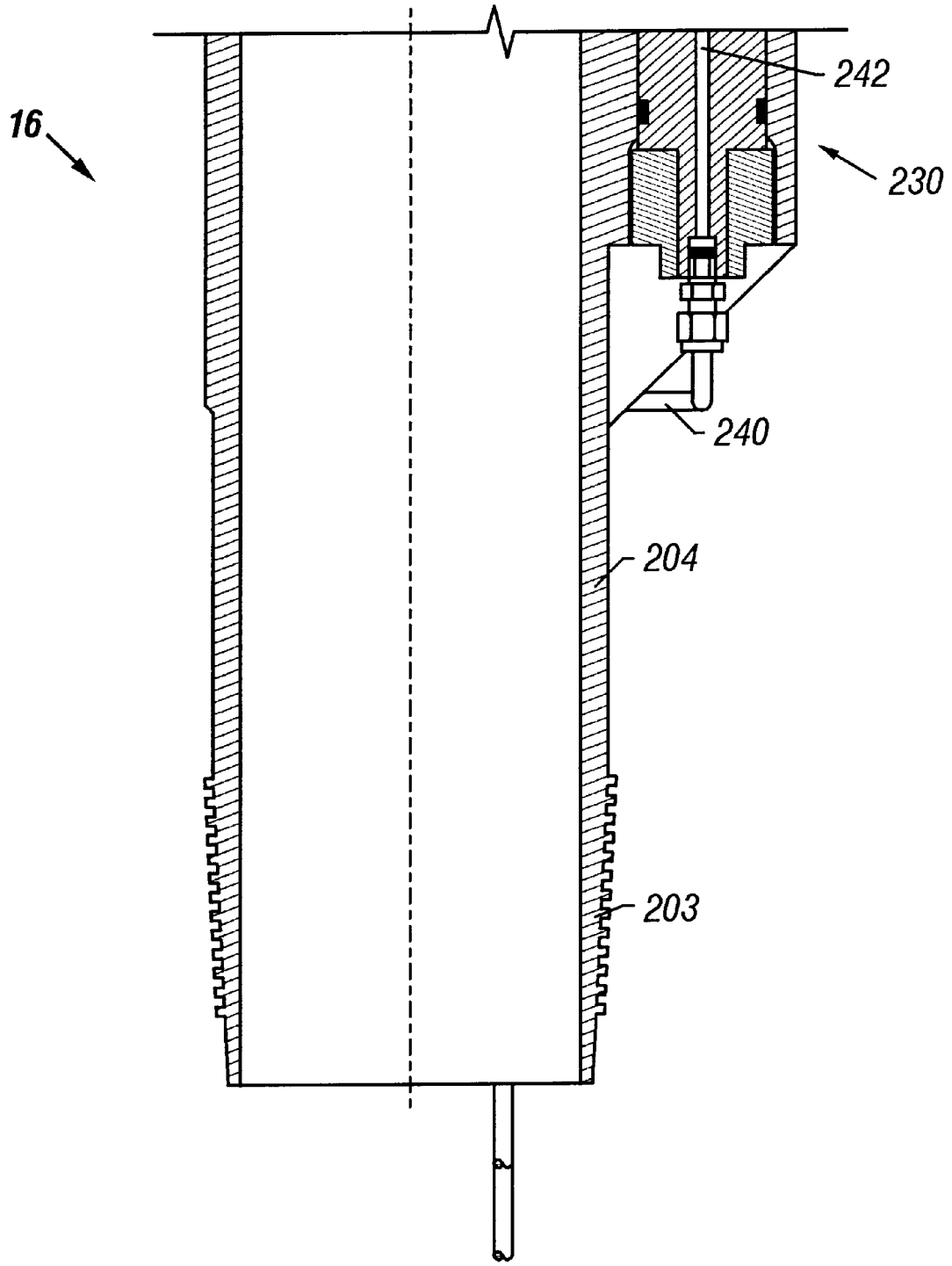

Referring to FIG. 1, a downhole string according to one embodiment in a wellbore 12 includes a production tubing 10 and a side pocket mandrel 16 having inlet orifices, or ports, 18 in the proximity of a perforated formation, or production zone, 14 adjacent the wellbore 12. The wellbore 12 may be lined with casing 20. Also, the completion string may include packers above and below the perforated formation 14. Although reference is made to a production tubing in the described embodiment, it is to be understood that the invention is not to be limited in this respect. Further embodiments may include other types of tubing, pipes, and other components through which fluids may flow. Thus, the term "tubing" as used in this discussion has a general meaning and includes pipes, annuluses, mandrels, and the like.

As mentioned the primary purpose of the present invention is to provide control of the flow rate of fluids into the production tubing 10 by choking the flow from the formation 14 into the tubing. However, the present invention may also have application to other procedures and applications. For example, in one alternative application of some embodiments of the downhole string, injection fluids may be injected down the tubing 10 from the well surface. The injection fluids are injected through the inlet orifices 18 into the formation 14 under elevated pressures. For example, this may aid in forcing or driving fluids from the formation 14 to strategically located producing wells, or other laterals in a multilateral well (not shown), within a producing field. In another alternative embodiment, the present invention may be used in a gas lift operation. Therefore, the inlet orifices 18 are useful for the passage of fluids into or out from the mandrel 16, even though the name used herein includes the word "inlet."

Figure 3:
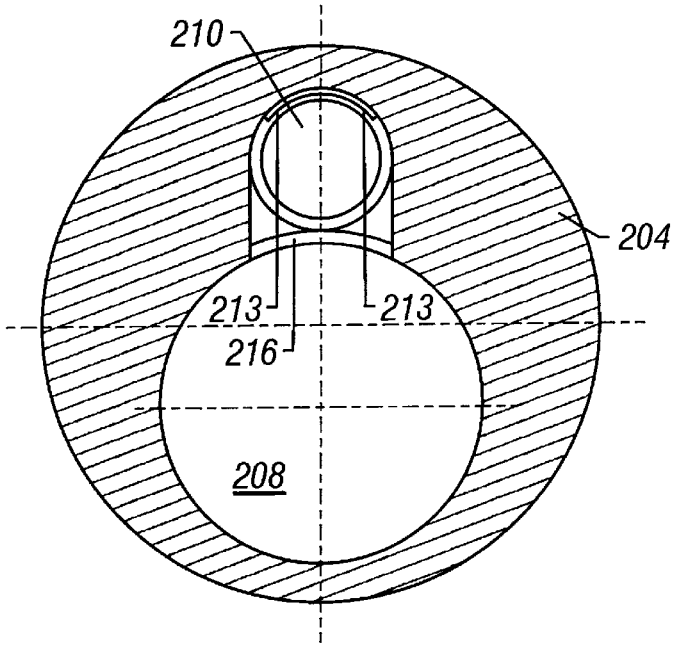
FIGS. 3–6 are cross-sectional diagrams of different portions of the side pocket mandrel of FIGS. 2A–2F.

Referring to FIGS. 2A–F, the side pocket mandrel 16 includes a main body 204 that has a threaded portion 202, or other attachment means, for attachment to the tubing 10. The main body 204 of the side pocket mandrel 16 defines a main bore 208 that is aligned with the bore of the tubing 10 and defines an outer wall 205. The side pocket mandrel 16 also includes an offset bore 210 defined in an offset portion 211 of the side pocket mandrel 16. The main bore 208 and offset bore 210 are further illustrated in FIG. 3, which is a cross-sectional view that is taken along section 3—3. As used in this discussion, the term "side pocket mandrel" includes any structure that includes a main bore and another bore that is offset from the main bore. The inlet orifices 18 are defined along the offset portion 211 of the main body 204. The inlet orifices 18 are adapted to enable fluid communication between the offset bore 210 and the outside of the side pocket mandrel body 204 (which may be the annulus between the side pocket mandrel 16 and the inner wall of the casing 20). Preferably, the combined cross sectional area of the inlet orifices 18 are substantially equal to or greater than the cross sectional area of the main bore 208 and of the tubing 10 to facilitate and allow full bore flow into the mandrel. Valves attached to the side pocket mandrel body 204 selectively control the flow rate through each inlet orifice 18. According to some embodiments, the valves are attached to the main body 204, as further described below.

An upper passageway 212 is defined in the side pocket mandrel 16 and provides communication between the upper part of the offset portion 211 of the side pocket mandrel body 204 and the main bore 208. The upper passageway 212 is adapted to receive a side pocket mandrel tool lowered into the main bore 208 of the side pocket mandrel 16 for positioning in the offset bore 210. The side pocket mandrel 16 includes a locating and orienting sleeve 206 for locating and aligning a kick over tool (not shown) to which a side pocket mandrel tool may be attached to position the side pocket mandrel tool in the offset bore 210.

An inner body portion 216 divides the main bore 208 from the offset bore 210 in the side pocket mandrel 16. The inner body portion 216 defines a radial flow passageway 218 to enable fluid communication between the main bore 208 and the offset bore 210 in a radial direction. The cross-sectional area of the radial flow passageway 218 is selected to be substantially equal to or greater than the cross-sectional area of the main bore 208 such that fluid flow rates in the main bore 208 and the radial flow passageway 218 are substantially matched to provide full bore flow. The offset bore 210 at its lower end feeds into an optional lower passageway 214 that leads back into the main bore 208 of the side pocket mandrel 16.

Figure 4:
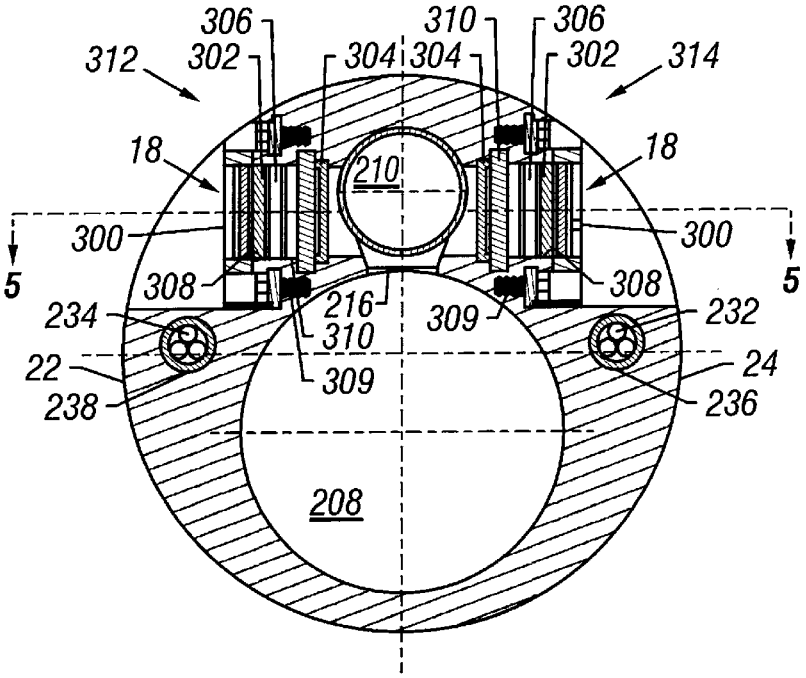
Figure 5:
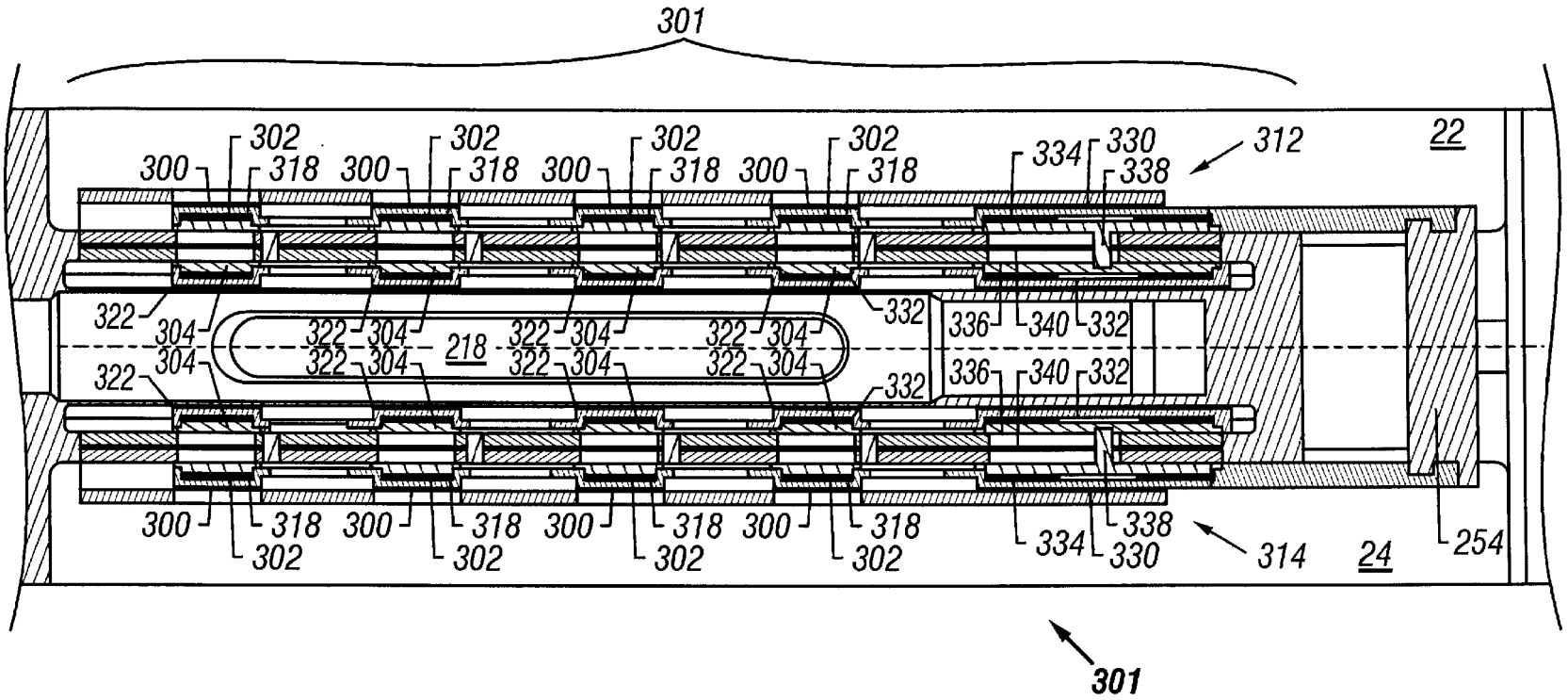

Referring to FIGS. 4 and 5, each inlet orifice 18 may be associated with a valve 300 having an outer cover 302 and an inner cover 304 on outer and inner sides of an opening 306. In the embodiment illustrated in FIG. 5, two rows of inlet orifices 18 are arranged longitudinally along the offset portion 211 of the side pocket mandrel body 204 with a first set 312 of inlet orifices 18 positioned on one side 22 of the mandrel 16 and a second set 314 of inlet orifices positioned on the opposite side 24 of the mandrel 16. Each of the inlet orifices are associated with an individual valve 300. It is contemplated that further embodiments may have the inlet orifices 18 arranged differently, and further, that one valve may be associated with more than one inlet orifice. Although the first and second sets, 312 and 314, are shown offset by 180°, it is anticipated that the offset could be at other relative angles, such as 90°, depending upon the desired flow characteristics.

The outer and inner covers 302 and 304 of each valve 300 may be in the form of disks that are in slidable engagement with seats 308 and 310, respectively. The covers 302 and 304 are slidable over the seats 308 and 310 to provide a variable orifice. Each valve 300 can selectively choke the opening 306 of the inlet orifice 18 to allow the inlet orifice 18 to be fully open to allow full open flow (the open position of the valves 300), fully closed to shut off fluid flow (the closed position of the valves 300), or at some incremental position between fully open and closed to restrict fluid flow incrementally. Note, however, that depending upon the actuator used to move the valves, the increments may be relatively large or the valve positioning may be continuous, or non-incremental, between the open and closed positions.

By having a cover on each side of the opening 306, pressure integrity in the valve 300 may be maintained in the presence of pressure from either direction (from outside the side pocket mandrel or from inside the side pocket mandrel). In further embodiments, a cover may be used only on one side of the opening 306 with some mechanism (such as a pre-load spring) included to apply a pre-load force against the cover so that the disc can maintain a seal even in the presence of pressure that tends to push the cover away from the seat of the valve 300. Valves according to different embodiments are described in U.S. patent application Ser. No. 09/243,401, filed Feb. 1, 1999, entitled "Valves for Use in Wells," which is hereby incorporated by reference. Further, other types of valves suitable for attachment to the side pocket, or offset portion 211, of a side pocket mandrel 16 or to the mandrel 16 as a whole, are anticipated and considered to be within the scope of the present invention.

To facilitate sliding movement of the covers 302 and 304 over surfaces of the seats 308 and 310 in each valve 300, contact surfaces of the covers and seats may be formed of or coated with a material having a relatively low coefficient of friction. Such a material may include polycrystalling-coated diamond (PCD). Other materials that may be used include vapor deposition diamonds, ceramics, silicone nitride, hardened steel, carbides, cobalt-based alloys, or other low friction materials having suitable erosion resistance.

In one embodiment, the covers 302 and 304 and seats 308 and 310 may be formed of a tungsten carbide material that is coated with PCD. By coating the covers 302 and 304 and the seats 308 and 310 with a material having a low coefficient of friction, each valve 300 may be opened or closed with reduced force even in the presence of high internal or external pressure acting on the inner or outer covers 302 or 304.

The valve position, and thus the flow through the inlet orifices 18 is controlled by using an actuator 230 attached to the valves 300. In the embodiment illustrated in FIG. 2, the actuator 230 is a hydraulic actuator that is responsive to pressure applied down tubes 232 and 234 located in longitudinal bores 236 and 238, respectively, that extend through the side pocket mandrel body 204 (FIGS. 2 and 4). The applied actuation pressure is communicated down through one (or more) of the tubes 232, 234 and through an angled tubing section 240 into an internal bore 242 at the lower end of the hydraulic actuator 230. The actuation pressure in the inner bore 232 is applied against an end surface of a piston 248 as well to one end of a sleeve 246. The other end of the sleeve 246 is in abutment with a spring 244. If the force applied by the actuation pressure in the inner bore 232 against the sleeve 246 and piston 248 is greater than the force of the spring 244, the sleeve 246 and piston 248 are moved upwardly by the applied pressure. The upper end of the piston 248 is attached to an indexing structure 250 which in turn is attached to an actuator bar 252. The indexing structure 250 is provided to position the actuator bar 252 at one of a plurality of positions to control opening and closing of the valves 300.

The actuator bar 252 in turn is attached to a valve actuator member 254 of the valve system 301 (FIGS. 2 and 5) that is connected to actuator cover carriers 330 and 332 for longitudinally moving the valves 300 back and forth. The actuator cover carriers 330 and 332 are attached to actuator covers 334 and 336, respectively. The actuator covers 334 and 336 are fixedly attached to each other by a coupling member 338 that is passed through an interconnecting port 340. The interconnecting port 340 allows the actuator covers 334 and 336 to move longitudinally so that the valve system 301 may be actuated to open, closed, and intermediate positions (also referred to herein as at and between the open and closed positions).

The actuator cover carriers 330 and 332 are connected to sequentially arranged disk carriers 318 and 322, respectively, each attached to respective covers 302 and 304.

Thus, longitudinal movement of the actuator member 254 in the valve system 301 by the actuator 230 causes carriers 318 and 322 of the individual valves 300 to move together between open, closed and intermediate positions. It is contemplated that in further embodiments the individual valves 300 may be independently actuated. For example, time delays may be provided in the opening and closing of each of valves 300. Separate actuators may be used to actuate the different valves 300, as another example.

Figure 6:
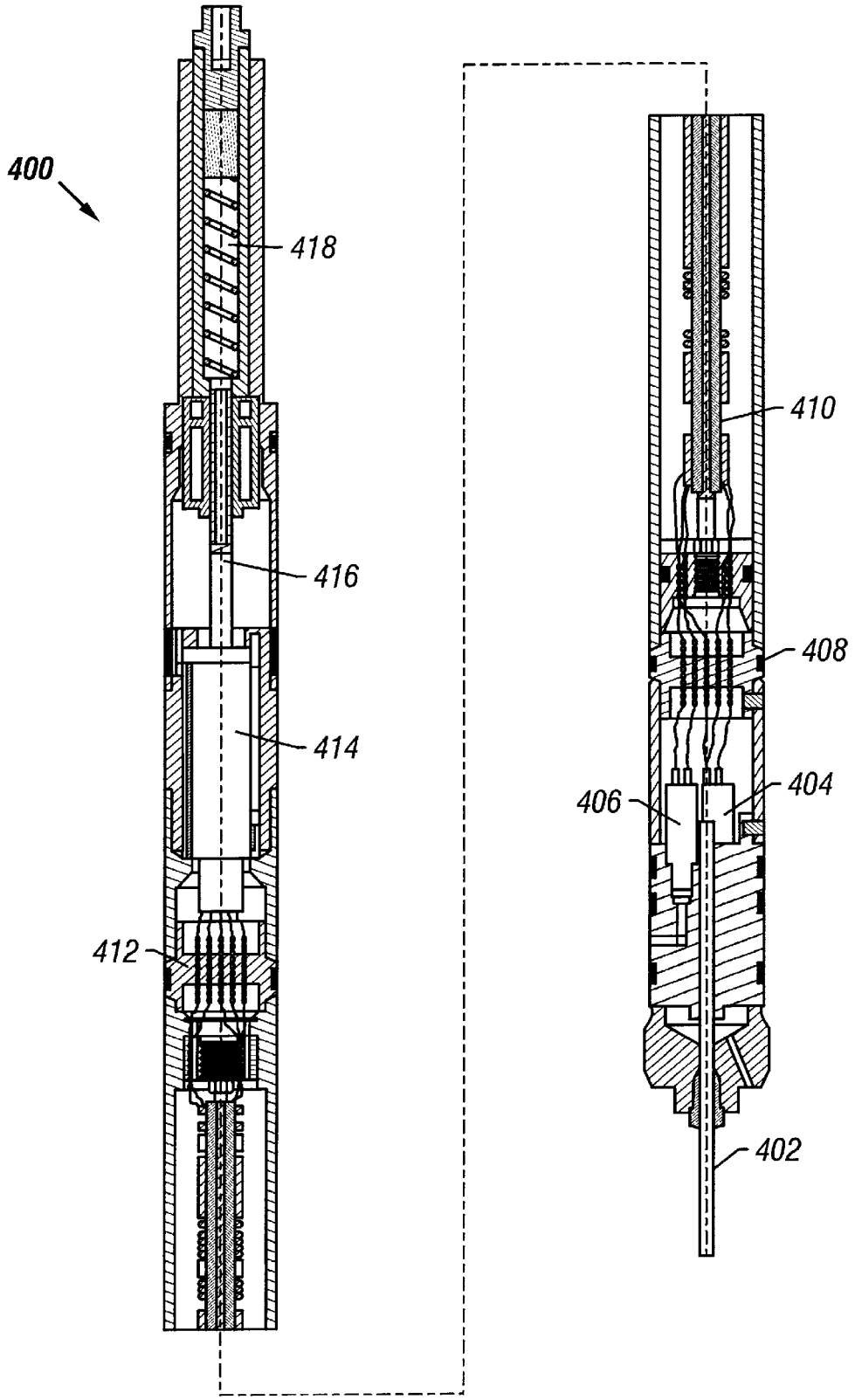

Referring to FIG. 6, according to another embodiment, an electrical actuator 400 can be used to actuate the valve system 301 instead of the hydraulic actuator 230. In this other embodiment, the longitudinal bores 236 and 238 (FIGS. 2 and 4) extending through the side pocket mandrel body 304 may be used to carry electrical cables instead of, or in addition to, hydraulic fluid tubes 232 and 234. The electrical cables may be fed through a tube 402 at the lower end of the electrical actuator 400. The electrical actuator 400 also includes a casing pressure sensor 404 to sense pressure outside the side pocket mandrel 16 and a tubing pressure sensor 406 to sense pressure inside the main bore 208 of the side pocket mandrel 16. Wires from the casing pressure sensor 404 and the tubing pressure sensor 406, as well as a wire in the tube 402, are routed through a cable connector member 408 to an electrical controller 410, which may include electronics components on a printed circuit board (PCB), for example. Depending on the received electrical activation signal in the wire routed through the tube 402 and signals representing pressures sensed by the pressure sensors 404 and 406, the electrical controller 410 is adapted to generate signals over wires routed through an electrical connector member 412 to a motor 414. The motor 414, controlled by the electric controller 410, is adapted to drive a rotatable shaft 416. Depending on the direction of rotation of the shaft 416, an attached worm gear 418 is actuated to move longitudinally up or down to move the attached actuator member 254 of the valve system 301.

Thus, in operation, the side pocket mandrel is capable of choking the flow of fluid from the formation 14 into the tubing 10. Fluid from the formation 14 flows through the inlet orifices 16 as controlled by the valves 300 and into the offset bore 210, through the radial passageway 218, and into the main bore 208 and the tubing 10. The actuator 230, which may be controlled from the surface or which may include mechanical or electrical "programming," such as preprogrammed responses to certain well conditions as indicated by downhole sensors (such as the casing pressure sensor 404 and the tubing pressure sensor 406), positions the valves 300 at or between the open and closed positions to selectively choke the flow into the mandrel 16.

A side pocket mandrel tool may be lowered from the surface down the tubing 10 and into the side pocket mandrel 16 using conventional methods and tools such as a slickline with a kickover tool. The locating and orienting sleeve 206 is adapted to facilitate positioning of the side pocket mandrel tool in the offset bore 210. One such side pocket mandrel tool is an injection valve tool, or "injection valve," 500 (FIGS. 7–9) that is adapted to receive injection fluids applied into the tubing 10 bore and the main bore 208 of the side pocket mandrel 16. The applied injection fluid is received in the injection valve tool 500 and applied through inlet orifices 18 to the outside of the side pocket mandrel 16 and into the formation 14.

FIGS. 7–9 disclose an embodiment of an injection valve tool 500 shown in three different positions in the side pocket mandrel 16. In FIG. 7, the injection valve tool 500 is shown in the run-in position, or "running position," with an adapter assembly 502 attached to the injection valve tool 500 during run in. The injection valve 500 has an injection valve body 503 with a first, upper end 505 and a second, lower end 506. An orienting key, or "alignment pin," 508 is located on the outer wall of the injection valve body 503 and is adapted to mate with a longitudinal groove between guide rails 213 attached to the inner wall of the body 204 in the upper passageway 212 of the side pocket mandrel 16. The orienting key 508 orients the tool 500 to a desired orientation as it is being positioned in the offset bore 210. Some distance apart from the orienting key 508 is a locking dog 510 shown in its retracted position in FIG. 7 during run in the injection valve tool 500. The locking dog 510 is adapted to mate with a recess, or "alignment groove," 512 defined in the inner wall of the main body 204 of the side pocket mandrel. The latching dog 510 is connected in the recess 512 to lock the injection valve tool 500 in the offset bore 210. The distance between the orienting key 508 and the locking dog 510 may be such that the orienting key 508 remains in the longitudinal groove defined by the rails 213 when the locking dog 508 is secured in the recess 512.

An upper seal 528 is located at an upper position along the injection valve tool 500 proximal the upper end 505 and a lower seal 530 is located at a lower position of the injection valve tool 500 proximal the lower end 506. Once the injection valve tool 500 is positioned in the offset bore 210, the seals 528 and 530 are engaged against the inner walls of the body 204 and the inner housing portion 216 (the walls defining the offset bore 210) to seal the space between the seals 528 and 530. When the injection valve 500 is positioned in the offset bore 210 the upper seal 528 is positioned above the inlet orifices 18 and the radial passageway 218 and the lower seal 530 is positioned below the inlet orifices 18 and the radial passageway 218.

As shown in FIG. 8, the injection valve tool 500 is in its set position in the offset bore 210. The adapter assembly 502 may be removed after run-in exposing a bore 532 defined in a tubular member 504 of the injection valve body 503 into which injection fluids in the main bore 208 of the side pocket mandrel 16 can flow. In a preferred embodiment, the injection valve body 503 defines a central bore 532 extending longitudinally therethrough. As illustrated, in the set position, the locking dog 510 is pushed outwardly into the recess 512 to lock the injection valve tool 500 in the offset bore 210. Injection fluid may be applied down the tubing bore and the bore 208 of the side pocket mandrel 16 into the central bore 532 of the injection valve tool 500.

Figure 10A:
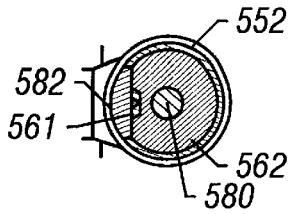
Figure 10B:
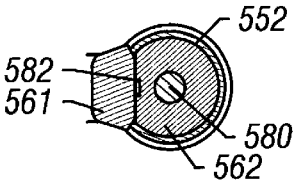

The injection valve tool 500 also includes a drive core 562 having an angled drive surface 564 adapted to engage a correspondingly angled surface 566 in an engagement section 561 of a radial plug 560. The angled drive surface 564 is adapted to be in slidable contact with the corresponding surface 566 of the radial plug 560. As the drive core 564 is driven down, the radial plug 560 is pushed outwardly so that it is extended from the injection valve body 503 to seal the radial passageway 218 defined in the inner housing portion 216. When pushed into sealing contact with the inner housing portion 216 around the passageway 218, the radial plug 560 is adapted to plug the radial passageway 218 to prevent fluid flow between the offset bore 210 and the main bore 208 of the side pocket mandrel 16. A spring 520 applies an upward force against the sleeve 568, which at its upper end provides a surface 570 for contacting the lower surface 572 of the longitudinally moveable tubular member 504. The tubular member 504 is pushed downwardly by the adapter 502 and run-in equipment attached to the adapter 502 during run in of the injection valve tool 500. When the lower surface 572 of the tubular member 504 contacts the upper surface 570 of the moveable sleeve 568, the sleeve 568 is pushed downwardly against the spring 520. This causes the drive core 562 to be driven down, which causes the radial plug 560 to be pushed outwardly against the radial passageway 218 of the inner housing portion 216 of the side pocket mandrel 16, as shown in FIG. 8. Thus, the spring 520 biases the radial plug 560 to an operative position in which the radial plug sealably engages the radial passageway. Note that the drive core 562 is adapted to permit the flow of fluids in the central bore 532 past the drive core 562. Cross-sectional views of the drive core 562 and the engagement section 561 of the radial plug 560 at their run-in and set positions are illustrated in FIGS. 10A and 10B, respectively. The engagement section 561 includes a generally T-shaped protruding section that is received by a correspondingly shaped groove in the drive core 562.

The applied fluid pressure pushes against a top sealing surface 534 (which in one embodiment has a generally hemispherical shape) of a check valve 514. The check valve 514 includes a spring 536 that pushes, or biases, the sealing surface 534 against a downwardly facing seat 538 provided by a sleeve 568 to form a seal. The same is also true of a lower check valve 516 located at the lower end of the injection valve tool 500. A spring 542 applies a force against the valve biasing the sealing surface 540 (which in one embodiment is generally semi-hemispherical) of the check valve 516 against an upwardly facing seat 541 provided by a lower housing section 546 of the injection valve body 503 to provide a fluid seal in the absence of elevated main bore pressure. The check valves 514 and 516, which are positioned in the central bore 532, define an interior cavity 522 as a portion of the central bore 532, the interior cavity 522 being that portion of the central bore 532 between the check valves, 514 and 516.

Accordingly, the check valves 514 and 516 are adapted to permit flow into the interior cavity 522 but prevent flow from the interior cavity 522. Preferably, the upper check valve 514 is positioned in the central bore 532 proximal the upper end 505 of the injection valve body 503 and proximal the upper seal 528 above the radial passageway 218 and the inlet orifices 18. Likewise, the lower check valve 516 is positioned in the central bore 532 proximal the lower end 506 of the injection valve body 503 and proximal the lower seal 530 below the radial passageway 218 and the inlet orifices 18.

Also note that, in the absence of elevated fluid pressure in the inner bore 532 of the injection valve tool 500, the spring 536 acts to maintain a seal between the sealing surface 534 and the seat 538 to prevent fluids from flowing into the interior cavity 522 of the injection valve body 503.

When injection fluids are applied at an elevated pressure down the tubing 210 and into the main bore 208 of the side pocket mandrel 16, the sealing surface 534 of the check valve 514 is pushed away from the seat 538 to allow injection fluid flow into the interior cavity 522 of the injection valve tool 500. The injection fluid then flows through injection passageways 550 defined by the injection valve body 503 into an annulus 518 between the wall of the offset bore 210 and the outer surface of the injection valve body 503 between the upper and lower seals 528, 530. The injection fluid that flows into the annulus 518 is allowed to flow out of the inlet orifices 18 if the valve system 301 is in the open or partially open states.

At the lower end of the injection valve tool 500, application of elevated injection fluid pressure pushes the sealing surface 540 of the check valve 516 away from the housing section 546 to allow injection fluid to flow into a lower interior cavity 554 and through injection passageways 556 into the annulus 518.

In operation, once the injection valve tool 500 is set in the offset bore 210, the radial plug 560 is positioned to seal the radial passageway 218 between the offset 210 and the main bore 208 of the side pocket mandrel 16. Thus, effectively, a portion of the offset bore 210 is sealed by seals 528, 530, and plug 560 so that the injection fluid path between the main bore 208 of the side pocket mandrel 16 and the formation 14 occurs through the injection valve tool 500 (through the inner bore 532, check valves 514 and 516, inner cavities 522 and 554, injection passageways, 550 and 556, and annulus 518) and the inlet orifices 18.

The injection valve tool 500 is removable. An initial position of the injection valve tool 500 during pull out is illustrated in FIG. 9. By applying an upward force against the injection valve tool 500, the locking dog 510 is retracted from the recess 512 in the side pocket mandrel body 204. Once the locking dog 510 is retracted, the injection valve tool 500 is unlocked and can be retrieved from the offset bore 210 and out of the side pocket mandrel 16 using standard techniques.

As mentioned, the main purpose of the present invention is for use in the production of fluids from the formation 14 to the surface through the main bore 208 of the side pocket mandrel 16 and the bore of the tubing 10. To detect the presence of particles or contaminates that may be harmful to the inner walls of tubings and pipes in the completion string positioned in the wellbore 12 and to protect the walls of the offset bore 210, a seal bore protector tool, or "seal bore protector," 600 may be lowered into the wellbore in position in the offset bore 210 of the side pocket mandrel 16. Referring to FIG. 11, a seal bore protector tool 600 is an alternative side pocket mandrel tool that may be positioned in the offset bore 210 of the side pocket mandrel 16. The seal bore protector 600 has an elongate seal bore protector body 601 having an upper end 608 and a lower end 610. The seal bore protector 600 includes an erosion coupon 602 as well as an upper seal 604 in an upper position of the tool, proximal the upper end of the tool 600, and a lower seal 606 at a lower position of the tool 600, proximal the lower end of the tool 600. When positioned and locked in the offset bore 210, the seal bore protector 600 defines a fluid flow path through inlet orifices 18, the space between the seals 604 and 606, the radial passageway 218, and the main bore 208. Thus, when the seal bore protector 600 is operatively positioned in the offset bore 210, the upper seal 604 is positioned above the inlet orifices 18 and the radial flow passageway 218 and the lower seal 606 is positioned below the inlet orifices 18 and the radial flow passageway 218.

The seal bore protector tool 600 includes an orienting key 610 and locking dog 612 that are adapted to orient and lock the tool 600 in the offset bore 210 and that operates as previously described above.

Production well fluids flowing from the surrounding formation 14 enters the inlet orifices 18, into the space defined between the seals 604 and 606, and through the radial passageway 218 to enter the main bore 208 of the side pocket mandrel. As mentioned, to avoid a reduction in the production flow rate, the effective cross-sectional area of the inlet orifices 18 and the cross-sectional area of the radial passageway 218 are each sized to be at least substantially the same as or greater than the cross-sectional area of the main bore 208 of the side pocket mandrel 16 or the tubing bore.

During production, contaminates may appear in the well fluids. Such contaminates may include sand, cement, or other elements that may cause wear damage the inner walls of the side pocket mandrel 16 and the tubing 10. To detect the presence of such damaging contaminates, the erosion coupon 602 is made of a material having material properties similar to those of the inner walls of the side pocket mandrel 16 or the tubing 10 or some other component downhole. For example, the erosion coupon may be made of a steel alloy such as INCONEL 718. To avoid restricting production fluid flow in the space between seals 604 and 606, the erosion coupon 602 has a diameter that is less than the diameter of the seals 604 and 606 or the diameter of the offset bore 210. The erosion coupon 602 has an outer shape that is adapted to direct flow through the offset bore 210 that reduces the amount of turbulence of the flow through the offset bore 210 and allow relatively unrestricted flow thereby. An example shape for the coupon 602 may be cylindrical.

The seal bore protector 600 may be removed periodically so that the erosion coupon 602 can be examined to determine if damage and contaminates exist in the wellbore fluid. If so, investigative and protective measures may be taken to reduce or prevent damage to the downhole components.

Referring to FIG. 12, a pack-off tool, or "pack off valve," 700 is another type of side pocket mandrel tool that may be positioned in the offset bore 210. The pack-off tool 700 is used to block off the inlet orifices 18 from the main bore 208 of the side pocket mandrel 16 in case of failure of the valve system 301. Thus, if the valves 300 in the valve system are stuck in an open or partially open position, the pack-off tool 700 may be lowered into the offset bore 210, with seals 702 and 704 to seal the region of the offset bore 210 between the seals 702 and 704. The pack off valve 700 has a pack off valve body 701 having an upper end 708 and a lower end 710. The pack-off tool 700 includes an orienting key 710 to orient the tool as it enters the offset bore 210 and a locking dog 712 to lock the pack-off tool 700 in the offset bore 210. The pack-off tool 700 also includes a drive core 706 that is driven by a mechanism similar to that of the injection valve tool 500 described in connection with FIGS. 7–9. The drive core 706 has an angled surface 722 that is in slidable engagement with a correspondingly angled surface 726 of an engagement section 724 of a radial plug 720. Downward movement of the drive core 706 pushes the radial plug outwardly to plug the radial passageway 218. Therefore, in general, the pack off valve 700 is similar in structure to the injection valve tool 500 except that the pack off valve 700 omits the check valves, 514 and 516, which allow flow through the injection valve 500. In this manner, the offset bore 210 is isolated from the main bore 208 of the side pocket mandrel 16 so that fluids entering inlet orifices 18 of a stuck-open valve system 301 are blocked from the side pocket mandrel and tubing bores.

The pack-off tool 700 according to one embodiment is capable of sealing the fluid path through the offset bore 210 without reducing the fluid flow area through the main bore 208 of the side pocket mandrel 16. The pack-off tool according to some embodiments is superior to conventional pack-off techniques in which a bridge plug is used. The bridge plug typically takes up some amount of the main fluid flow bore so that a restriction in the production bore is created that may periodically limit production flow rate and reentry. In addition, the pack-off tool 700 according to some embodiments is more convenient to remove than conventional pack-off tools such as the bridge plug.

Other types of side pocket mandrel tools may also be used with the side pocket mandrel according to some embodiments that have been described. Such other side pocket mandrel tools may perform other types of tasks or operations downhole such as downhole measurements and chemical treatment of the valve system.

In addition, components of the invention disclosed in this description may be varied, with some components removed or substituted with other types of components. For example, the radial passageway 218 may be omitted, other actuators 230, such as a solenoid, may be used, the radial plug 560 of the well tools may be replaced with a seal adapted to surround the radial passageway 218 to block flow therethrough, the mandrel 16 may incorporate a plurality of radial passageways 218 rather than one, other types of valves may be used to control the flow through the inlet orifices 18, other orienting devices may be used to orient the well tools in the side pocket, and other like changes may be made without varying from the scope of the present invention.

FIG. 13 is a cross sectional view of one such alternative embodiment. In the embodiment shown, the offset bore 210 incorporates a measurement device 800. In one alternative embodiment, the measurement device 800 is a flow meter adapted to measure the flow rate of the fluid through the offset bore 210. In another alternative embodiment, the measurement device 800 is a pressure meter adapted to measure the pressure in the offset bore 210 or the differential pressure between the offset bore and the annulus formed between the mandrel 16 and the casing 20. In one embodiment, the pressure meter 800 communicates with the offset bore 210 via passageways 804 and with the annulus via passageways 802 to facilitate the measurement. A communication line 801 interconnected to the measurement device 800 communicates with the measurement device and facilitates transmission of data and power therefrom and/or thereto.

FIG. 14 is a cross sectional view of another alternative embodiment for the present invention in which the side pocket mandrel 16 has an offset bore 210 and an additional offset bore 900. The additional offset bore 900 has the same characteristics as the offset bore 210 including an additional upper passageway 902, an additional radial flow passageway 904, inlet orifices 18 communicating therewith, as well as the other features previously discussed in connection with the offset bore 18. Flow through the inlet orifices communicating with the additional offset bore 900 is controlled by valves 300, shown in the drawing schematically as a single disk type valve previously discussed. Additional offset bores 900 may be useful for increased flow capability, redundancy or for other purposes. Of course, the additional offset bore 900 may have other characteristics, such as those commonly found in standard side pocket mandrels, to perform other functions such as housing meters, power sources, control units, and the like. In these other embodiments, the additional offset bore 900 may omit the inlet orifices 18 and/or the additional radial passageway 904 depending upon the application.

While the foregoing is directed to the preferred embodiment of the present invention, other and further embodiments of the invention may be devised without departing from the basic scope thereof, and the scope thereof is determined by the claims which follow. It is the express intention of the applicant not to invoke 35 U.S.C. §112, paragraph 6 for any limitations of any of the claims herein, except when the claim expressly uses the words "means for" together.

What is claimed is:

1. A side pocket mandrel, comprising:

a body having an outer wall, the body defining a main bore extending therethrough and an offset bore adjacent the main bore;

the main bore adapted to be aligned with a well tubing;

the body further defining an upper passageway extending between and adapted to provide fluid communication between the main bore and an upper end of the offset bore;

the body further defining a lower passageway extending between and adapted to provide fluid communication between the main bore and a lower end of the offset bore;

the body defining at least one radial flow passageway, the at least one radial flow passageway being adapted to provide fluid communication between the main bore and the offset bore;

the at least one radial flow passageway separate from and offset from the upper passageway and lower passageway; and the body defining at least one inlet orifice through the outer wall thereof, the at least one inlet orifice adapted to provide fluid communication into and from the offset bore of the body.

2. The mandrel of claim 1, wherein the cross sectional area of the at least one radial flow passageway is substantially equal to or greater than the cross sectional area of the main bore.

3. The mandrel of claim 1, wherein the at least one radial flow passageway has a cross sectional area that is substantially equal to or greater than the cross sectional area of the main bore.

4. The mandrel of claim 1, further comprising:

at least one valve attached to the body, the at least one valve adapted to selectively choke the flow through the at least one inlet orifice.

5. The mandrel of claim 4, wherein:

the at least one valve is slideably attached to the body.

6. The mandrel of claim 1, further comprising:

the body defining a plurality of inlet orifices through an outer wall thereof, the plurality of inlet orifices adapted to provide fluid communication into and from the offset bore of the body; and a valve associated with each of the plurality of inlet orifices, the valve adapted to selectively control the flow rate through the associated inlet orifice.

7. The mandrel of claim 6, further comprising:

at least one actuator attached to and adapted to actuate the valves.

8. The mandrel of claim 7, wherein the at least one actuator is hydraulic.

9. The mandrel of claim 7, wherein the at least one actuator is electric.

10. The mandrel of claim 1, wherein the upper passageway is adapted to selectively receive a side pocket mandrel tool therethrough.

11. The mandrel of claim 1, further comprising:

the body further defining at least one additional offset bore that is separate from the offset bore, the at least one additional offset bore adjacent the main bore; and the body defining at least one additional radial flow passageway associated with each of the at least one additional offset bores, the at least one additional radial flow passageway is adapted to provide fluid communication between the main bore and the associated one of the at least one additional offset bores.

12. The mandrel of claim 11, further comprising:

the body defining an additional upper passageway associated with each of the at least one additional offset bores, the additional upper passageways extending between and adapted to provide fluid communication between the main bore and an upper end of the associated one of the at least one additional offset bores;

the additional upper passageways adapted to selectively receive a side pocket mandrel tool therethrough; and the at least one additional radial flow passageways offset from the additional upper passageways.

13. A side pocket mandrel, comprising:

a body having an outer wall, the body defining a main bore extending therethrough and an offset bore adjacent the main bore;

the main bore adapted to be aligned with a well tubing;

the body further defining an upper passageway extending between and adapted to provide fluid communication between the main bore and an upper end of the offset bore;

the body defining at least one radial flow passageway, the at least one radial flow passageway being adapted to provide fluid communication between the main bore and the offset bore;

the at least one radial flow passageway offset from the upper passageway; and the body defining at least one inlet orifice through the outer wall thereof, the at least one inlet orifice adapted to provide fluid communication into and from the offset bore of the body, the combined cross sectional areas of the at least one inlet orifices being substantially equal to or greater than the cross sectional area of the main bore.

14. A side pocket mandrel, comprising:

a body having an outer wall, the body defining a main bore extending therethrough and an offset bore adjacent the main bore;

the main bore adapted to be aligned with a well tubing;

the body further defining an upper passageway extending between and adapted to provide fluid communication between the main bore and an upper end of the offset bore;

the body defining at least one radial flow passageway, the at least one radial flow passageway being adapted to provide fluid communication between the main bore and the offset bore;

the at least one radial flow passageway offset from the upper passageway; and the body defining at least one inlet orifice through the outer wall thereof, the at least one inlet orifice adapted to provide fluid communication into and from the offset bore of the body, a first set of the plurality of inlet orifices extending through one side of the body into the offset bore;

a second set of the plurality of inlet orifices extending through an opposite side of the body into the offset bore;

the inlet orifices of the first set aligned substantially longitudinally on the body and the inlet orifices of the second set aligned substantially longitudinally on the body.

15. A side pocket mandrel, comprising:

a body having an outer wall, the body defining a main bore extending therethrough and an offset bore adjacent the main bore;

the main bore adapted to be aligned with a well tubing;

the body further defining an upper passageway extending between and adapted to provide fluid communication between the main bore and an upper end of the offset bore;

the body defining at least one radial flow passageway, the at least one radial flow passageway being adapted to provide fluid communication between the main bore and the offset bore;

the at least one radial flow passageway offset from the upper passageway; and the body defining at least one inlet orifice through the outer wall thereof, the at least one inlet orifice being adapted to provide fluid communication into and from the offset bore of the body, the cross sectional area of the at least one radial flow passageway substantially equal to or greater than the cross sectional area of the main bore;

the body defining a plurality of inlet orifices through an outer wall thereof, the plurality of inlet orifices adapted to provide fluid communication into and from the offset bore of the body;

a valve associated with each of the plurality of inlet orifices, the valve adapted to selectively control the flow rate through the associated inlet orifice, the combined cross sectional areas of the plurality of inlet orifices being substantially equal to or greater than the cross sectional area of the main bore;

a first set of the plurality of inlet orifices extending through one side of the body into the offset bore;

a second set of the plurality of inlet orifices extending through an opposite side of the body into the offset bore;

the inlet orifices of the first set aligned substantially longitudinally on the body and the inlet orifices of the second set aligned substantially longitudinally on the body; and at least one actuator attached to and adapted to actuate the valves.

16. A system for controlling the flow of fluid into and from a downhole tubing, the system comprising:

a mandrel adapted to be attached to the tubing, the mandrel defining a main bore extending therethrough and adapted to be aligned with the tubing, and an offset bore adjacent to the main bore;

the mandrel defining at least one inlet orifice adapted to provide communication into and from the offset bore of the mandrel; and at least one valve attached to the mandrel, the at least one valve adapted to control the flow rate through the at least one inlet orifice, the at least one valve selectively positionable at and between an open position and a closed position, the combined cross sectional area of the at least one inlet orifice being substantially equal to or greater than the cross sectional area of the main bore.

17. A system for controlling the flow of fluid into and from a downhole tubing, the system comprising:

a mandrel adapted to be attached to the tubing, the mandrel defining a main bore extending therethrough and adapted to be aligned with the tubing, and an offset bore adjacent to the main bore;

the mandrel defining at least one inlet orifice adapted to provide communication into and from the offset bore of the mandrel; and at least one valve attached to the mandrel, the at least one valve adapted to control the flow rate through the at least one inlet orifice, the at least one valve selectively positionable at and between an open position and a closed position, the at least one valve comprising a member slidable over the at least one inlet orifice.

18. The system of claim 17, further comprising a side pocket mandrel tool comprising:

a pack-off valve adapted to be selectively and removeably positioned in the offset bore.

19. The system of claim 18, wherein the pack-off valve further comprises:

an elongate pack-off valve body having an upper end and a lower end;

an upper seal attached to the pack-off valve body proximal upper end;

a lower seal attached to the pack-off valve body proximal the lower end;

the upper and lower seals adapted to seal the offset bore above and below the inlet orifices respectively and substantially prevent flow past the upper and lower seals when the pack-off valve body is operatively positioned in the offset bore.

20. The system of claim 19, further comprising:

the mandrel defining at least one radial passageway extending between and adapted to provide fluid communication between the main bore and the offset bore;

an alignment pin attached to the pack-off valve body;

an alignment groove defined by the mandrel;

the alignment pin and alignment groove adapted to cooperatively align the pack-off valve body to a predetermined orientation as the pack-off valve is positioned in the offset bore;

a radial plug corresponding to each of the at least one radial passageways, the radial plug having a size and shape corresponding to the size and shape of the corresponding one of the at least one radial passageways;

the radial plug attached to the pack-off valve body and selectively moveable relative to the pack-off valve body between a running position and a set position, in which the radial plug is extended from the pack-off valve body; and the radial plug adapted to sealably close the corresponding one of the at least one radial passageways when the pack-off valve is positioned in the offset bore and the radial plug is in the set position.

21. The system of claim 20, further comprising:

the upper seal is positioned above the at least one radial passageway when the pack-off valve is operatively positioned in the offset bore; and the lower seal are positioned below the at least one radial passageway when the pack-off valve is operatively positioned in the offset bore.

22. The system of claim 21, further comprising:

the pack-off valve body defining a central bore therein, the central bore sealed to prevent flow through the pack-off valve;

a drive core slideably mounted within the central bore;

the drive core having an angled drive surface;

the radial plug slideably connected to the angled drive surface of the drive core;

the angled drive surface adapted and oriented to force the radial plug outward toward the corresponding one of the at least one radial passageways as the drive core is operatively moved within the central bore.

23. The system of claim 22, further comprising:

the angled drive surface is frustoconical and oriented with the smaller diameter of the drive surface nearer the lower end of the pack-off valve than the larger diameter end; and the angled drive surface adapted and oriented to force the radial plug outward toward the corresponding one of the at least one radial passageways as the drive core moves downward in the central bore of the pack-off valve.

24. The system of claim 23, further comprising:

the drive core biased toward an operative position in which the radial plug sealably engages the corresponding one of the at least one radial passageways.

25. The system of claim 17, further comprising:

a flow meter positioned in the offset bore;

a communication line attached to the flow meter adapted to transmit data from the flow meter.

26. The system of claim 17, further comprising:

a pressure meter positioned in the offset bore;

a communication line attached to the pressure meter adapted to transmit data from the pressure meter.

27. The system of claim 17, further comprising:

an upper passageway extending between the main bore and the offset bore, the upper passageway adapted to receive a side pocket mandrel tool therethrough.

28. The system of claim 17, wherein the member comprises a cover.

29. A system for controlling the flow of fluid into and from a downhole tubing, the system comprising:

a mandrel adapted to be attached to the tubing, the mandrel defining a main bore extending therethrough and adapted to be aligned with the tubing, and an offset bore adjacent to the main bore;

the mandrel defining at least one inlet orifice adapted to provide communication into and from the offset bore of the mandrel; and at least one valve attached to the mandrel, the at least one valve adapted to control the flow rate through the at least one inlet orifice, the at least one valve selectively positionable at and between an open position and a closed position;

a side pocket mandrel tool comprising a seal bore protector adapted to be selectively and removeably positioned in the offset bore;

the seal bore protector comprising an erosion coupon.

30. The system of claim 29, wherein the seal bore protector further comprises:

an elongate body having an upper end and a lower end;

an upper seal attached to the body proximal upper end;

a lower seal attached to the body proximal the lower end;

the upper and lower seals adapted to seal the offset bore above and below the inlet orifices respectively and substantially prevent flow past the upper and lower seals when the body is operatively positioned in the offset bore.

31. The system of claim 29, wherein:

the erosion coupon comprises a material having material properties similar to the material properties of the body.

32. The system of claim 29, wherein:

the erosion coupon comprises a material having material properties similar to at least one other downhole component.

33. The system of claim 29, wherein:

the erosion coupon comprises a steel alloy.

34. The system of claim 29, wherein:

the erosion coupon comprises INCONEL 718.

35. The system of claim 29, wherein:

the erosion coupon has a diameter that is less than the diameter of the upper and lower seals, the erosion coupon having a diameter adapted to allow relatively unrestricted flow thereby.

36. The system of claim 29, wherein:

the erosion coupon has an outer shape adapted to direct the flow through the offset bore.

37. The system of claim 29, wherein:

the erosion coupon has an outer shape adapted to reduce the turbulence of the flow through the offset bore.

38. A system for controlling the flow of fluid into and from a downhole tubing, the system comprising:

a mandrel adapted to be attached to the tubing, the mandrel defining a main bore extending therethrough and adapted to be aligned with the tubing, and an offset bore adjacent to the main bore;

the mandrel defining at least one inlet orifice adapted to provide communication into and from the offset bore of the mandrel; and at least one valve attached to the mandrel, the at least one valve adapted to control the flow rate through the at least inlet orifice, the at least one valve selectively positionable at and between an open position and a closed position, the mandrel further defining at least one radial passageway extending between and adapted to provide fluid communication between the main bore and the offset bore, the combined cross sectional area of the at least one radial passageway being substantially equal to or greater than the cross sectional area of the main bore.

39. A system for controlling the flow of fluid into and from a downhole tubing, the system comprising:

a mandrel adapted to be attached to the tubing, the mandrel defining a main bore extending therethrough and adapted to be aligned with the tubing, and an offset bore adjacent to the main bore;

the mandrel defining at least one inlet orifice adapted to provide communication into and from the offset bore of the mandrel; and at least one valve attached to the mandrel, the at least one valve adapted to control the flow rate through the at least one inlet orifice, the at least one valve selectively positionable at and between an open position and a closed position; and a side pocket mandrel tool comprising an injection valve adapted to be selectively and removeably positioned in the offset bore, wherein the injection valve comprises:

an injection valve body having an upper end and a lower end;

an upper seal attached to the injection valve body proximal the upper end;

a lower seal attached to the injection valve body proximal the lower end;

the upper and lower seals adapted to seal the offset bore above and below the inlet orifices respectively and to substantially prevent flow past the upper and lower seals when the injection valve body is operatively positioned in the offset bore;

the injection valve body and the offset bore defining an annulus between the upper and lower seals;

the injection valve body defining an interior cavity therein;

at least one check valve adapted and positioned to permit flow into the interior cavity but to prevent flow from the interior cavity;

the injection valve body defining at least one injection passageway adapted to provide fluid communication between the annulus and the interior cavity.

40. The system of claim 39, further comprising:

the injection valve body defining a central bore therethrough;

an upper check valve attached to the injection valve body, the upper check valve positioned in the central bore proximal the upper end of the injection valve body;

a lower check valve attached to the injection valve body, the lower check valve positioned in the central bore proximal the lower end of the injection valve body; and the upper and lower check valves defining the interior cavity as a portion of the central bore; and the upper and lower check valves adapted and positioned to permit flow into the interior cavity through the central bore but to prevent flow from the interior cavity through the central bore.

41. The system of claim 40, further comprising:

the upper check valve positioned proximal the upper seal; and the lower check valve positioned proximal the lower seal.

42. The system of claim 40, further comprising:

the mandrel defining at least one radial passageway extending between and adapted to provide fluid communication between the main bore and the offset bore;

an alignment pin attached to the injection valve body;

an alignment groove defined by the mandrel;

the alignment pin and alignment groove adapted to cooperatively align the injection valve body to a predetermined orientation as the injection valve is positioned in the offset bore;

a radial plug corresponding to each of the at least one radial passageways, the radial plug having a size and shape corresponding to the size and shape of the corresponding one of the at least one radial passageways;

the radial plug attached to the injection valve body and selectively moveable relative to the injection valve body between a running position and a set position, in which the radial plug is extended from the injection valve body; and the radial plug adapted to sealably close the corresponding one of the at least one radial passageways when the injection valve body is positioned in the offset bore and the radial plug is in the set position.

43. The system of claim 42, further comprising:

the upper seal and upper check valve are positioned above the at least one radial passageway when the injection valve body is operatively positioned in the offset bore; and the lower seal and lower check valve are positioned below the at least one radial passageway when the injection valve body is operatively positioned in the offset bore.

44. The system of claim 43, further comprising:

a drive core slideably mounted within the central bore of the injection valve body;

the drive core having an angled drive surface;

the radial plug slideably connected to the angled drive surface of the drive core;

the angled drive surface adapted and oriented to force the radial plug outward toward the corresponding one of the at least one radial passageways as the drive core is operatively moved within the central bore of the injection valve body.

45. The system of claim 44, further comprising:

the angled drive surface is frustoconical and oriented with the smaller diameter of the drive surface nearer the lower end of the injection valve body than the larger diameter end; and the angled drive surface adapted and oriented to force the radial plug outward toward the corresponding one of the at least one radial passageways as the drive core moves downward in the central bore of the injection valve body.

46. The system of claim 44, further comprising:

the drive core biased toward an operative position in which the radial plug sealably engages the corresponding one of the at least one radial passageways.

47. The system of claim 44, further comprising:

the drive core adapted to permit the flow of fluids in the central bore past the drive core.

48. A system for controlling the flow of fluid into and from a downhole tubing, the system comprising:

a mandrel adapted to be attached to the tubing, the mandrel defining a main bore extending therethrough and adapted to be aligned with the tubing, and an offset bore adjacent to the main bore;

the mandrel defining at least one inlet orifice adapted to provide communication into and from the offset bore of the mandrel;

at least one valve attached to the mandrel, the at least one valve adapted to control the flow rate through the at least one inlet orifice, the at least one valve selectively positionable at and between an open position and a closed position, a plurality of inlet orifices; and a valve associated with each of the plurality of inlet orifices, the valve adapted to control the flow through the associated one of the plurality of inlet orifices, the mandrel having opposing sides;

a first set of the plurality of inlet orifices positioned on one of the opposing sides; and a second set of the plurality of inlet orifices positioned on the other of the opposing sides.

49. The system of claim 48, further comprising:

each of the valves comprises:

at least one cover adapted for sliding movement at and between a closed position, in which the at least one cover substantially seals the associated one of the plurality of inlet orifices, and an open position, in which the at least one cover is substantially removed from over the associated one of the plurality of inlet orifices; and at least one actuator coupled to and adapted to move the at least one cover of the valves.

50. The system of claim 49, wherein the at least one actuator comprises an electric actuator.

51. The system of claim 49, wherein the at least one actuator comprises a hydraulic actuator.

52. A method for controlling the flow rate of a fluid into a tubing, the method comprising:

providing a mandrel having at least one side pocket and at least one inlet orifice providing fluid communication into the at least one side pocket; and adjusting a position of at least one cover with respect to the at least one orifice to choke the flow rate of the fluid through the at least one orifice.

53. The method of claim 52, further comprising:

providing a valve comprising the at least one cover associated with each of the at least one inlet orifices; and selectively moving the valves at and between a closed position, in which flow is substantially prevented through the associated one of the at least one orifices, and an open position, in which the valve substantially uncovers the associated one of the at least one orifices.

54. The method of claim 52, further comprising:

providing a radial flow passageway between a main bore of the mandrel and the side pocket.

55. A valve, comprising:

a mandrel having an outer wall and defining a main bore and an offset bore;

at least one inlet orifice defined in and extending through the outer wall and communicating with the offset bore;

at least one cover adapted to choke the flow through the at least one orifice.

56. The valve of claim 55, further comprising:

a plurality of inlet orifices defined in and extending through the outer wall and communicating with the offset bore;

a cover associated with each of the plurality of orifices; and an actuator adapted to selectively move the covers.

57. The mandrel of claim 56, wherein the at least one actuator is hydraulic.

58. The mandrel of claim 56, wherein the at least one actuator is electric.

59. The valve of claim 56, further comprising:

a first set of the plurality of inlet orifices extending through one side of the outer wall of the mandrel into the offset bore;

a second set of the plurality of inlet orifices extending through an opposite side of the outer wall of the mandrel into the offset bore;

the inlet orifices of the first set aligned substantially longitudinally on the body and the inlet orifices of the second set aligned substantially longitudinally on the body.

60. An apparatus for controlling the flow rate of a fluid into a tubing, comprising:

a mandrel having a main bore, at least one side pocket and at least one inlet orifice providing fluid communication into the side pocket; and the at least one side pocket having an upper portion and a lower portion, the mandrel further having a radial passageway defined between the upper portion and the lower portion, the radial passageway providing a fluid path between the main bore and the at least one side pocket.

61. The apparatus of claim 60, wherein the mandrel has an upper passageway providing fluid communication between the main bore and the upper portion of the side pocket, the upper passageway being separate from the radial passageway.

62. The apparatus of claim 61, wherein the mandrel further comprises a lower passageway providing fluid communication between the main bore and the lower portion of the side pocket, the lower passageway being separate from the radial passageway.

63. The apparatus of claim 60, wherein the mandrel has at least another side pocket.

64. The apparatus of claim 60, further comprising a flow meter adapted to measure flow rate of fluid through the offset bore.

65. A tool string comprising:

a fluid flow conduit; and a side pocket mandrel having:

a main bore in communication with the fluid flow conduit;

a side pocket; and a body defining a radial passageway between the main bore and the side pocket, a cross-sectional area of the radial passageway being substantially equal to or greater than a cross-sectional area of the fluid flow conduit.

66. The tool string of claim 65, wherein the side pocket mandrel further comprises at least one inlet orifice adapted to provide communication into and from the offset bore.

67. The tool string of claim 66, wherein the side pocket mandrel further comprises at least one valve to control fluid flow through the at least one orifice.

68. The tool string of claim 67, wherein the at least one valve comprises a cover moveable to an open position, a closed position, and at least an intermediate position.

69. The tool string of claim 65, wherein the body further defines at least one of an upper passageway and a lower passageway to the side pocket, the radial passageway separate from and offset from the at least one of the upper passageway and the lower passageway.

70. The tool string of claim 65, wherein the body further defines an upper passageway and a lower passageway to the side pocket, the radial passageway separate from the upper and lower passageways.

* * * * *

UNITED STATES PATENT AND TRADEMARK OFFICE

CERTIFICATE OF CORRECTION

PATENT NO. : 6,227,302 B1 
DATED : May 8, 2001
INVENTOR(S) : Ronald E. Pringle and Clay W. Milligan, Jr.

It is certified that error appears in the above-identified patent and that said Letters Patent is hereby corrected as shown below:

Title page,
Item [73], Assignee, delete "Cameo" and insert -- Camco --.

Drawings,
Replace drawing sheets 11-13 with revised drawing sheets 11-13.

Column 9,
Line 19, delete "polycrystalling-coated", and insert -- polycrystaline-coated --.

Signed and Sealed this

Twenty-second Day of April, 2003

JAMES E. ROGAN
*Director of the United States Patent and Trademark Office*